US012152356B2

(12) United States Patent
Landry et al.

(10) Patent No.: US 12,152,356 B2
(45) Date of Patent: Nov. 26, 2024

(54) IMPELLER FOR SNOWBLOWER AND COMBINED SNOWBLOWER AND SNOWPLOW

(71) Applicant: 9277-9347 QUEBEC INC., Ste-Geneviève de Berthier (CA)

(72) Inventors: Jocelyn Landry, Ste-Geneviève de Berthier (CA); Dave Malenfant, St-Alexandre (CA)

(73) Assignee: 9277-9347 QUEBEC INC., Ste-Geneviève de Berthier (CA)

( * ) Notice: Subject to any disclaimer, the term of this patent is extended or adjusted under 35 U.S.C. 154(b) by 1066 days.

(21) Appl. No.: 17/060,039

(22) Filed: Sep. 30, 2020

(65) Prior Publication Data

US 2021/0095433 A1 Apr. 1, 2021

Related U.S. Application Data

(60) Provisional application No. 62/948,583, filed on Dec. 16, 2019, provisional application No. 62/908,903, filed on Oct. 1, 2019.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/045; E01H 5/098
See application file for complete search history.

(56) References Cited

U.S. PATENT DOCUMENTS

| | | | |
|---|---|---|---|
| 1,227,308 | A | 5/1917 | Plank |
| 1,496,621 | A | 6/1924 | Burrell |
| 1,543,222 | A | 6/1925 | Mcveety |
| 1,624,421 | A | 4/1927 | Meyer |
| 1,894,516 | A | 1/1933 | Karstedt |
| 2,192,254 | A | 3/1940 | Beadle |

(Continued)

FOREIGN PATENT DOCUMENTS

| | | | |
|---|---|---|---|
| AT | 521690 A4 * | 4/2020 | ..... E01H 5/045 |
| AU | 2009202478 | 1/2010 | |

(Continued)

*Primary Examiner* — Jessica H Lutz
(74) *Attorney, Agent, or Firm* — Valauskas Corder LLC

(57) ABSTRACT

There is provided a snowblower comprising a frame with a transversally extending portion; an auger assembly mounted to the frame and comprising a rotating axle extending substantially parallel to the transversally extending portion and a snow-gathering device mounted to rotating axle and rotating therewith about an auger rotating axis at an auger revolution speed; an impeller assembly mounted to the frame and comprising a snow-expelling device rotatable about an impeller rotation axis at an impeller revolution speed, the impeller rotation axis extending substantially parallel to the auger rotating axis; an actuator assembly configured to engage the auger and impeller assemblies in rotation wherein the impeller revolution speed is greater than the auger revolution speed; and a discharge chute mounted to the frame and having a discharge chute inlet adjacent to the impeller assembly. There is also provided a method for clearing away snow.

14 Claims, 22 Drawing Sheets

(56) References Cited

U.S. PATENT DOCUMENTS

| | | | | |
|---|---|---|---|---|
| 2,986,826 | A | 6/1961 | Timmons | |
| 3,378,084 | A | 4/1968 | Ulrich | |
| 3,478,448 | A * | 11/1969 | Bacon | E01H 5/098 37/252 |
| 3,780,813 | A | 12/1973 | Davis et al. | |
| 3,797,582 | A | 3/1974 | Couch | |
| 3,901,618 | A | 8/1975 | SantAgata | |
| 3,987,562 | A | 10/1976 | Deen et al. | |
| 4,044,843 | A | 8/1977 | Holub | |
| 4,304,057 | A | 12/1981 | Watson et al. | |
| 4,356,645 | A * | 11/1982 | Hine | E02F 3/7613 172/825 |
| 4,702,641 | A | 10/1987 | Naser et al. | |
| 4,834,191 | A * | 5/1989 | Vecchio | E02F 3/815 172/784 |
| 4,892,155 | A | 1/1990 | Wanamaker | |
| 5,010,961 | A | 4/1991 | Frisbee | |
| 5,125,174 | A | 6/1992 | Watson et al. | |
| 5,181,574 | A | 1/1993 | Dion | |
| 5,343,959 | A | 9/1994 | Frisbee et al. | |
| 5,410,824 | A | 5/1995 | Pedersen | |
| 5,413,181 | A | 5/1995 | Keigley | |
| 5,609,437 | A | 3/1997 | Silva | |
| 5,676,489 | A | 10/1997 | Willhoite | |
| 5,718,295 | A | 2/1998 | Trahan | |
| 5,720,353 | A | 2/1998 | Wilkening | |
| 5,778,567 | A | 7/1998 | Jager et al. | |
| 5,806,214 | A | 9/1998 | Behrens et al. | |
| 5,807,061 | A | 9/1998 | Donoghue et al. | |
| 5,890,546 | A | 4/1999 | Kerpash, Sr. | |
| 5,909,960 | A | 6/1999 | Jager et al. | |
| 6,178,669 | B1 | 1/2001 | Quenzi et al. | |
| 6,209,231 | B1 | 4/2001 | Curtis | |
| 6,240,659 | B1 | 6/2001 | Curtis et al. | |
| 6,276,076 | B1 | 8/2001 | Quenzi et al. | |
| 6,283,225 | B1 | 9/2001 | Hermonson | |
| 6,442,877 | B1 | 9/2002 | Quenzi et al. | |
| 6,484,813 | B2 | 11/2002 | Tapio et al. | |
| 6,526,677 | B1 | 3/2003 | Bloxdorf et al. | |
| 6,578,295 | B1 | 6/2003 | McPherson et al. | |
| 6,594,924 | B2 | 7/2003 | Curtis | |
| 6,792,704 | B2 | 9/2004 | Johnson | |
| 6,843,002 | B1 | 1/2005 | Moffitt | |
| 6,928,757 | B2 | 8/2005 | Bloxdorf et al. | |
| 7,117,617 | B2 | 10/2006 | Kost et al. | |
| 7,273,111 | B2 | 9/2007 | Johnson | |
| 7,454,850 | B2 | 11/2008 | Smith | |
| 7,617,882 | B1 | 11/2009 | Street | |
| 7,681,337 | B2 * | 3/2010 | Watson | E01H 5/065 37/274 |
| 7,841,110 | B2 | 11/2010 | Koch et al. | |
| 7,963,052 | B2 | 6/2011 | Koch et al. | |
| 8,292,000 | B2 | 10/2012 | Takami et al. | |
| 8,656,615 | B1 | 2/2014 | Fournier et al. | |
| 8,678,103 | B2 | 3/2014 | Miyuki et al. | |
| 8,689,898 | B2 | 4/2014 | Benesch | |
| 8,869,911 | B2 | 10/2014 | Anderson | |
| 9,027,663 | B2 | 5/2015 | Gartenmaier et al. | |
| 9,260,836 | B2 | 2/2016 | Nakata et al. | |
| 10,267,015 | B2 | 4/2019 | Landry et al. | |
| 11,732,430 | B2 * | 8/2023 | Favorito | E01H 5/065 37/242 |
| 2005/0126052 | A1 | 6/2005 | Ono et al. | |
| 2006/0249293 | A1 | 11/2006 | Christian | |
| 2007/0209240 | A1 | 9/2007 | Huehnergard et al. | |
| 2009/0194304 | A1 | 8/2009 | Backus | |
| 2011/0011604 | A1 | 1/2011 | Takami et al. | |
| 2011/0239491 | A1 * | 10/2011 | Chen | E01H 5/045 37/253 |
| 2013/0000929 | A1 | 1/2013 | Anderson | |
| 2016/0251825 | A1 | 9/2016 | Landry et al. | |

FOREIGN PATENT DOCUMENTS

| | | |
|---|---|---|
| CA | 2141021 | 7/1996 |
| CA | 2222338 | 6/1998 |
| CA | 2226236 | 7/1998 |
| CA | 2358359 | 4/2002 |
| CA | 2735837 | 4/2002 |
| CA | 2462885 | 4/2003 |
| CA | 2538398 | 9/2007 |
| CA | 2872166 | 11/2013 |
| CA | 2957773 | 6/2017 |
| CH | 198043 A * | 8/1937 |
| CN | 202416407 | 9/2012 |
| CN | 202989975 | 6/2013 |
| CN | 109594597 | 4/2019 |
| DE | 3608893 | 9/1987 |
| EP | 1369531 | 12/2003 |
| EP | 1533426 | 5/2005 |
| JP | 53046712 | 6/2006 |
| JP | 2006144411 | 6/2006 |
| JP | S53046712 | 6/2006 |
| WO | 2012150867 | 11/2012 |

* cited by examiner

IMPELLER FOR SNOWBLOWER AND COMBINED SNOWBLOWER AND SNOWPLOW

PRIOR APPLICATIONS

The present application claims priority from U.S. provisional patent application No. 62/908,903, filed on Oct. 1, 2019, and entitled "IMPELLER FOR SNOWBLOWER AND COMBINED SNOWBLOWER AND SNOW PLOW", and from US. provisional patent application No. 62/948,583, filed on Dec. 16, 2019, and entitled "IMPELLER FOR SNOWBLOWER AND COMBINED SNOWBLOWER AND SNOW PLOW", the disclosure of which being hereby incorporated by reference in their entirety.

TECHNICAL FIELD OF THE INVENTION

The technical field relates to snowblowers as apparatuses for blowing snow. More particularly, it relates to a snowblower impeller that is adapted to propel snow and to a snowblower including same. It also relates to a snowblower in combination with a snowplow.

BACKGROUND

Snowblowers, also known as snow throwers, are used for removing snow and ice from the ground and propel the snow/ice at a distance from the cleared ground for both commercial and residential operations.

Some snowblowers include an auger assembly and an impeller assembly, separated from the auger assembly. The auger assembly includes an endless screw in front of the apparatus to break the snow and the ice in smaller portions and feed the impeller assembly. Then, the rotatable impeller assembly propels the snow/ice at a distance from the snowblower through a discharge chute.

In conventional snowblowers, the endless screw of the auger assembly rotates about a first axis while the rotatable impeller rotates about a second axis, normal to the first axis (See for instance US2015/0252542). The endless screw is typically located forwardly of the impeller. Therefore, the snowblower must remain at a certain distance from obstacle.

Another type of snow removal apparatus is a snowplow which is used to move snow from one location to another by either pushing or pulling snow. Both snowplows and snowblowers have pros and cons. Therefore, it is conventional to equip a motorized vehicle, such as a tractor, with a snowplow at one end, either the front or the rear end, and a snowblower at the opposed end. However, this is not possible to be combined on all types of vehicles.

BRIEF SUMMARY OF THE INVENTION

It is therefore an aim of the present invention to address the above-mentioned issues.

According to a general aspect, there is provided a snowblower comprising: a snowblower frame with a transversally extending portion; an auger assembly mounted to the snowblower frame and comprising at least one rotating axle extending substantially parallel to the transversally extending portion and at least one snow-gathering device mounted to the at least one rotating axle and rotating therewith about an auger rotating axis at an auger revolution speed; an impeller assembly mounted to the snowblower frame and comprising at least one snow-expelling device rotatable about an impeller rotation axis at an impeller revolution speed, the impeller rotation axis extending substantially parallel to the auger rotating axis; at least one actuator assembly configured to engage the auger assembly and the impeller assembly in rotation wherein the impeller revolution speed is greater than the auger revolution speed; and a discharge chute mounted to the snowblower frame and having a discharge chute inlet adjacent to the impeller assembly.

According to another general aspect, there is provided a snowblower comprising a snowblower frame with a transversally extending portion; an auger assembly mounted to the snowblower frame and comprising at least one rotating axle extending substantially parallel to the transversally extending portion and at least one snow-gathering device mounted to the at least one rotating axle and rotating therewith about an auger rotating axis at an auger revolution speed; an impeller assembly mounted to the snowblower frame and comprising an impeller driving shaft and at least one snow-expelling device supported by the impeller driving shaft and rotatable about an impeller rotation axis at an impeller revolution speed, wherein the impeller driving shaft extends parallel to the at least one rotating axle and is spaced apart therefrom; and a discharge chute mounted to the snowblower frame and having a discharge chute inlet adjacent to the impeller assembly.

According to another general aspect, there is provided a snowblower and snowplow assembly comprising: a snowblower frame with a transversally extending portion comprising two opposed ends; an auger assembly mounted to the snowblower frame and comprising at least one rotating axle extending substantially parallel to the transversally extending portion and at least one snow-gathering device mounted to the at least one rotating axle and rotating therewith about an auger rotating axis at an auger revolution speed; an impeller assembly mounted to the snowblower frame and comprising at least one snow-expelling device rotatable about an impeller rotation axis at an impeller revolution speed, the impeller rotation axis extending substantially parallel to the auger rotating axis; a discharge chute mounted to the snowblower frame and having a discharge chute inlet adjacent to the impeller assembly; two wings pivotally mounted to the opposed ends of the transversally extending portion, and pivotable about wing pivot axes extending substantially vertically; and two wing actuators, each one having a first end mounted to the snowblower frame and a second end mounted to a respective one of the two wings, said two wing actuators being configurable in a retracted configuration and an extended configuration wherein said two wings extend at least one of forwardly and rearwardly with respect to the transversally extending portion of the frame.

According to another general aspect, there is provided a method for clearing away snow with a snowblower according to the present disclosure, comprising simultaneously engaging in rotation the at least one rotating axle of the auger assembly and said at least one snow-expelling device of the impeller assembly with the impeller revolution speed being greater than the auger revolution speed.

According to another general aspect, there is provided a method for clearing away snow, comprising: simultaneously engaging in rotation at least one rotating axle of an auger assembly having at least one snow-gathering device mounted thereto and at least one snow-expelling device of an impeller assembly with the impeller revolution speed being greater than the auger revolution speed.

According to another general aspect, there is provided a snowblower comprising: a snowblower frame with a transversally extending portion; an auger assembly mounted to the snowblower frame and comprising at least one rotating axle extending substantially parallel to the snowblower frame and at least one helical screw segment mounted to the at least one rotating axle and rotating therewith at an axle revolution speed; an impeller assembly mounted to the snowblower frame and comprising a plurality of paddles rotating simultaneously with the at least one rotating axle at an impeller revolution speed; at least one actuator assembly configured to engage the auger assembly and the impeller assembly in rotation and to impart a higher revolution speed to the impeller assembly than to the auger assembly; and a discharge chute mounted to the snowblower frame and having a discharge chute inlet extending above the impeller assembly.

In an embodiment, the at least one actuator assembly comprises a transmission assembly operatively connected to the impeller assembly and the at least one rotating axle and configured to increase the impeller revolution speed with respect to the axle revolution speed.

According to another general aspect, there is provided a snowblower comprising: a snowblower frame with a transversally extending portion; an auger assembly mounted to the snowblower frame and comprising at least one rotating axle extending substantially parallel to the snowblower frame and at least one helical screw segment mounted to the at least one rotating axle and rotating therewith about an auger rotating axis; an impeller assembly mounted to the snowblower frame and comprising a plurality of paddles rotatable about an impeller rotation axis, extending substantially parallel to the auger rotating axis; a transmission assembly connecting the impeller assembly to the at least one rotating axle to increase a revolution speed of the impeller assembly with respect to a revolution speed of the rotating axis; and a discharge chute mounted to the snowblower frame and having a discharge chute inlet extending above the impeller assembly.

In an embodiment, the impeller rotation axis is concentric with the auger rotating axis.

According to still another general aspect, there is provided a snowblower and snowplow assembly comprising: a snowblower frame with a transversally extending portion; an auger assembly mounted to the snowblower frame and comprising at least one rotating axle extending substantially parallel to the snowblower frame and at least one helical screw segment mounted to the at least one rotating axle and rotating therewith; an impeller assembly mounted to the snowblower frame and comprising a plurality of paddles rotatable about an impeller rotation axis; a discharge chute mounted to the snowblower frame and having a discharge chute inlet extending above the impeller assembly; and two wings pivotally mounted to the transversally extending portion of the frame, at opposed ends thereof; and pivotable about wing pivot axes extending substantially vertically; and wing actuators, each one having a first end mounted to the snowblower frame and a second end mounted to a respective one of the two wings, the wing actuators being configurable in a retracted configuration and an extended configuration wherein the wings extend at least one of forwardly and rearwardly with respect to the transversally extending portion of the frame.

According to still a further general aspect, there is provided a method for snowblowing snow. The method comprises: simultaneously engaging in rotation at least one rotating axle of an auger assembly having at least one helical screw segment mounted thereto and a plurality of paddles of an impeller assembly with the impeller assembly having a higher revolution speed than the at least one rotating axle, the at least one helical screw segment and the plurality of paddles rotating about respectively an auger rotating axis and an impeller rotation axis, extending substantially parallel to the auger rotating axis.

BRIEF DESCRIPTION OF THE DRAWINGS

It will be noted that throughout the appended drawings, like features are identified by like reference numerals.

DETAILED DESCRIPTION

Figure 1:
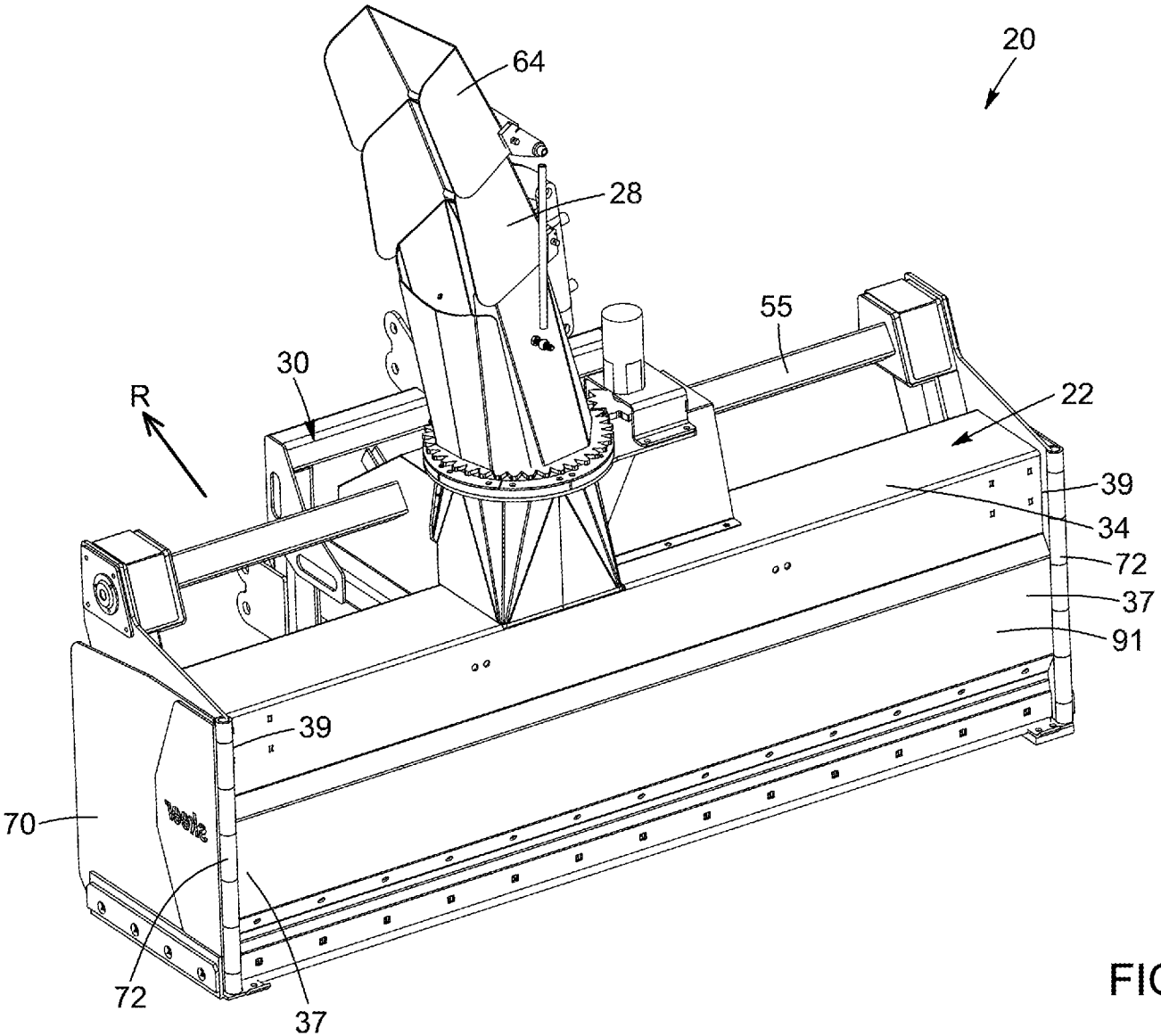
FIG. 1 is a front perspective view of a snowblower in accordance with a first embodiment, including two wings pivoted rearwardly and extending substantially perpendicular to a transversally extending portion of a snowblower frame, the snowblower comprising impeller and auger rotation axes parallel and spaced apart from each other.

Moreover, although the embodiments of the snowblower and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the snowblower, as will be briefly explained herein and as can be easily inferred herefrom by a person skilled in the art.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of the snowblower and corresponding parts when supported on a ground surface or when in use, for instance when secured to a vehicle, with the "front" corresponding to a position located forwardly of the snowblower with respect to a direction of advance thereof and the "rear" corresponding to a position located on a side of a vehicle attachment assembly or handles of the snowblower. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

Furthermore, it is to be understood that the invention can be carried out or practiced in various ways and that the invention can be implemented in embodiments other than the ones outlined in the description above.

It is to be understood that the terms "including", "comprising" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element. It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

The present invention may be implemented in the testing or practice with methods and materials equivalent or similar to those described herein.

Snowblower

Figure 2:
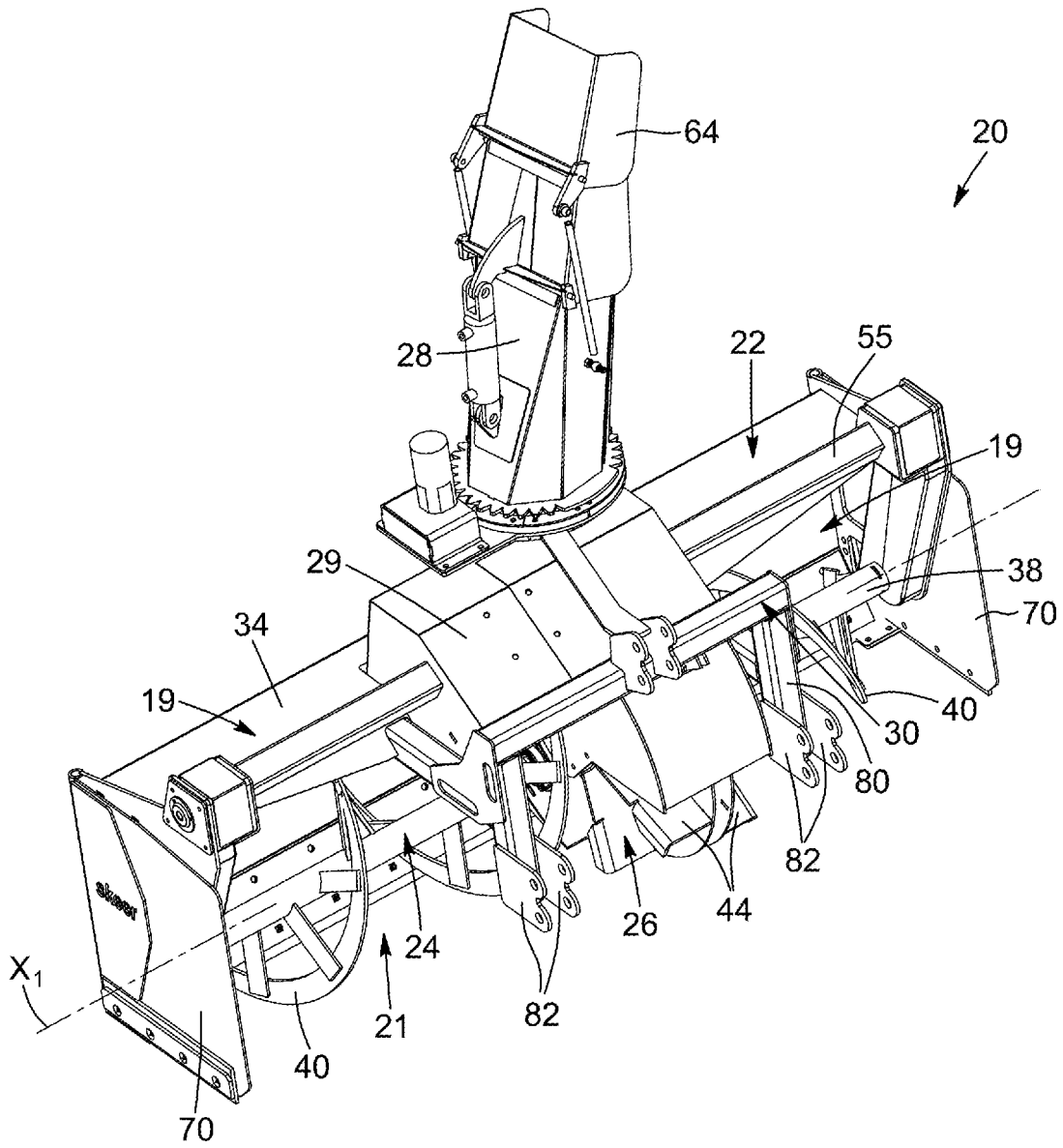
FIG. 2 is a rear perspective view of the snowblower shown in FIG. 1.

Referring to the figures and, more particularly, referring to FIGS. 1 and 2, there is shown a snowblower 20 (also referred to as snow thrower or a combined snowblower and snowplow) including a frame 22 (or snowblower frame 22) supporting an auger assembly 24, an impeller assembly 26, a discharge chute 28, and a vehicle attachment assembly 30. The snowblower 20 is securable to a motorized vehicle such as a tractor (not shown) using a vehicle attachment assembly 30. The motorized vehicle has an attachment side to which the snowblower 20 is secured. As it is known in the art, the attachment side can be either located forwardly or rearwardly of the motorized vehicle cabin. Thus, the snowblower 20 can be either mounted to the front or to the rear of the motorized vehicle. It is known that such snowblowers, sometimes referred to as two-stage snowblowers, are configured so that the auger assembly 24 pulls snow into the snowblower 20, conveys the snow towards the impeller assembly 26 and feed the snow into the impeller assembly 26 which in turn directs the snow out of the discharge chute 28, extending substantially upwardly (substantially vertically in the embodiment shown), so as to throw the snow to another location or into a truck to be hauled away.

Vehicle Attachment Assembly

In the embodiment shown, the vehicle attachment assembly 30 is located on the side of the snowblower 20 including the auger assembly 24 and the impeller assembly 26. However, it is appreciated that, in an alternative embodiment (not shown), the vehicle attachment assembly 30 can be provided on the opposite side of the snowblower 20, i.e. the side opposed to the side including the auger assembly 24 and the impeller assembly 26.

Thus, for instance, if the snowblower 20 is mounted to the front of the motorized vehicle and with the vehicle attachment assembly 30 located on the side of the snowblower 20 including the auger assembly 24 and the impeller assembly 26, the motorized vehicle is driven in reverse to remove snow from the ground with the snowblower 20.

It is appreciated that, in an alternative embodiment, the snowblower could be a self-powered snowblower, also referred to as a personal snowblower or walk-behind snowblower, including a pair of handles for a user to grasp to operate the snowblower, a pair of wheels, an engine driving the wheels, the impeller assembly, and the auger assembly.

Snowblower Frame and Relative Arrangement of the Auger and Impeller Assemblies

The frame 22 includes a transversally extending portion 34 with axle supports 36 (FIG. 5) mounted at oppose longitudinal ends. The transversally extending portion 34 defines a longitudinal direction of the snowblower 20. In the embodiment shown, the axle supports 36 extend rearwardly but it is appreciated that, in an alternative embodiment (not shown), the axle supports 36 could extend forwardly. The auger assembly 24 is mounted to and extends between the axle supports 36. It includes a rotating axle 38—or auger rotating axle 38—onto which two snow-gathering devices 40—for instance two helical screw segments 40—are mounted. The rotating axle 38 extends substantially parallel to the transversally extending portion 34. The snow-gathering devices 40 are mounted to the rotating axle 38 and rotate therewith about an auger rotating axis X1 at an auger revolution speed.

The snow-gathering devices 40 are shaped and dimensioned to direct snow, upon rotation of the auger assembly 24 about the auger rotation axis X1, towards the impeller assembly 26 and towards a discharge chute inlet 60 (FIG. 8) of the discharge chute 28, adjacent to the impeller assembly 26. In other words, the auger assembly 24 is configured to convey snow concentrically towards the impeller assembly 26 and the discharge chute inlet 60. An auger assembly having any other type of snow-gathering devices, such as paddles mounted to and extending around the rotating axle 38 and rotatably mounted to the snowblower frame 22 could also be conceived.

In the non-limitative embodiment shown, the helical screw segments 40 are mounted to the auger axle 38. For instance, the helical screw segments could be mounted to the auger axle 38 through clamps surrounding the auger rotating axle 38 or by any other mechanical fastener. For instance, it is appreciated that, in an alternative embodiment (not shown), the helical screw segments 40 can be welded directly to the auger rotating axle, as it is known in the art, or could be made integral with the rotating axle 38. The rotating axle 38 extends substantially parallel to the transversally extending portion 34 of the frame 22 and is spaced-apart therefrom.

In the embodiment shown, the auger assembly 24 includes two auger rotating axles 38 which are concentric and aligned but spaced-apart from one another. More particularly, the impeller assembly 26 extends between the two rotating axles 38. Each one of the rotating axles 38 is rotatably mounted to and extends between two axle supports 36. A respective one of the two helical screw segments 40—or snow-gathering devices 40—is mounted to each one of the rotating axles 38.

Figure 9:
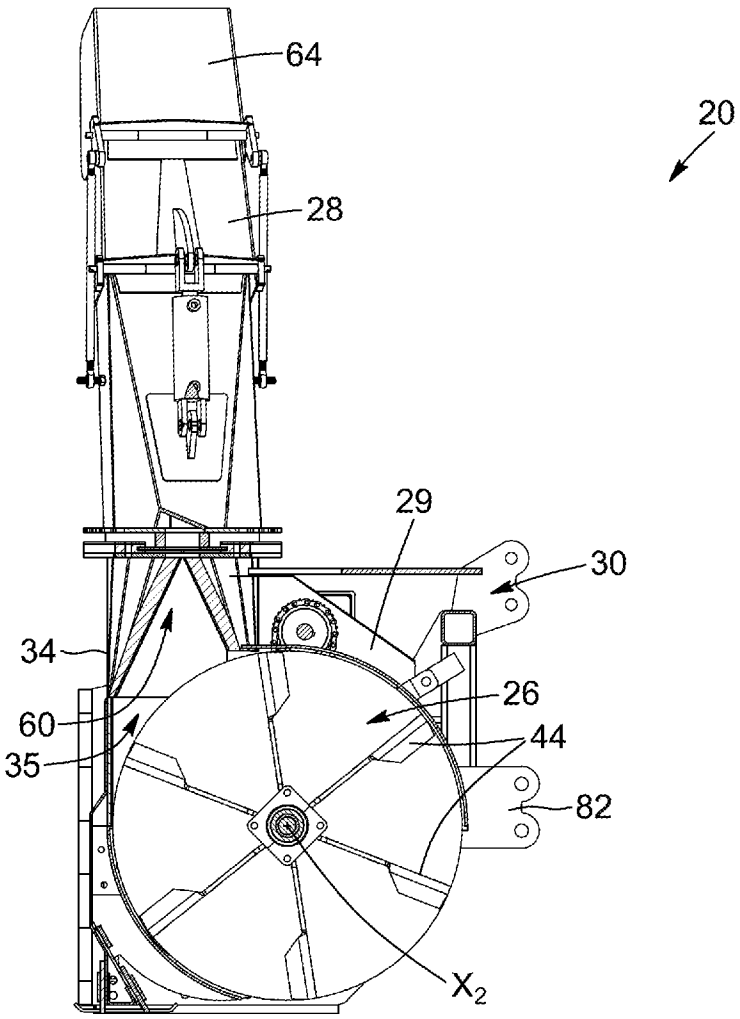
FIG. 9 is a cross-sectional view of the snowblower shown in FIG. 3 along section lines 9-9.
Figure 10:
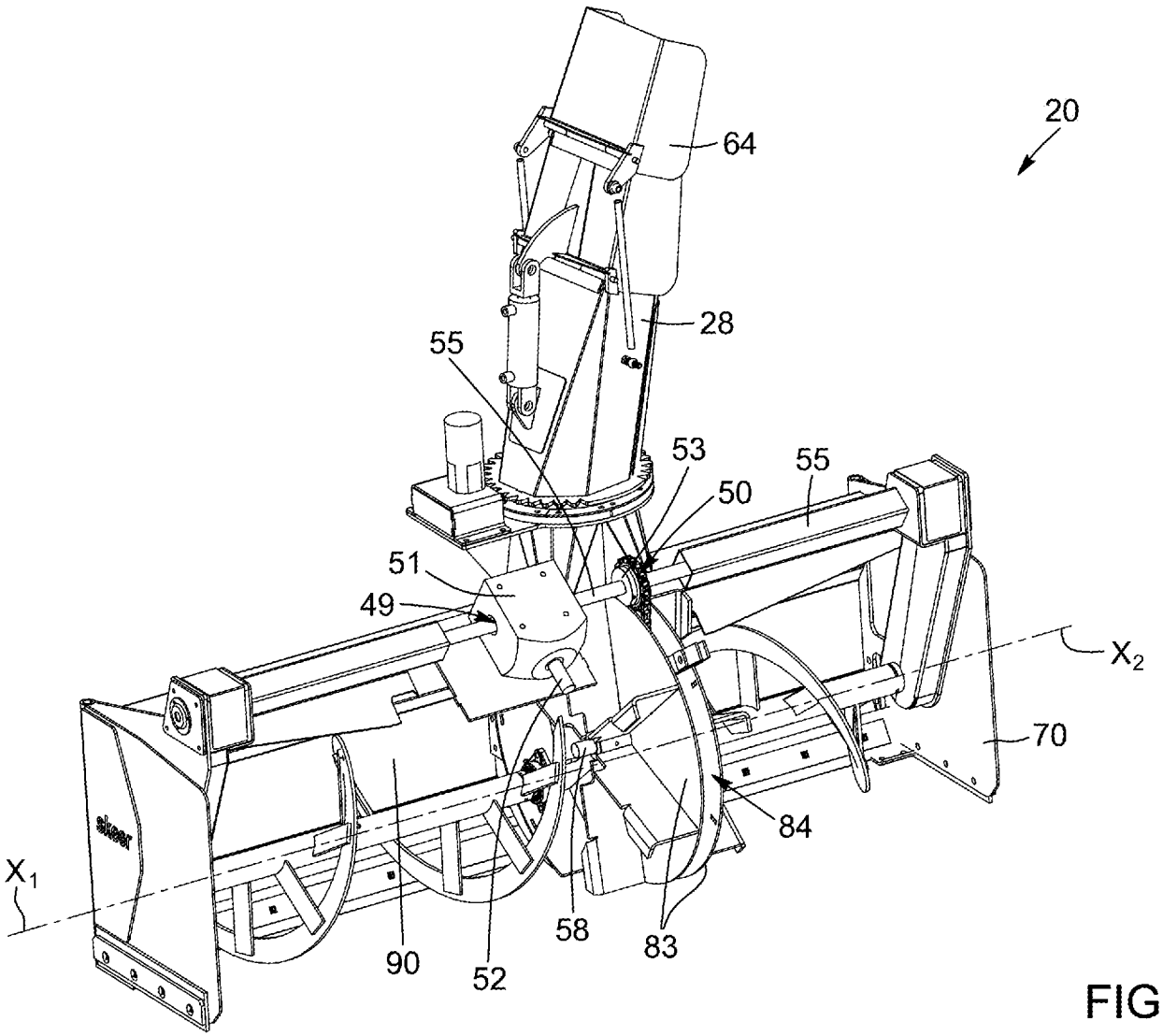
FIG. 10 is a left-side and rear perspective view of the snowblower shown in FIG. 2, wherein a vehicle attachment assembly and an impeller-feeding hood have been removed to expose same.
Figure 11:
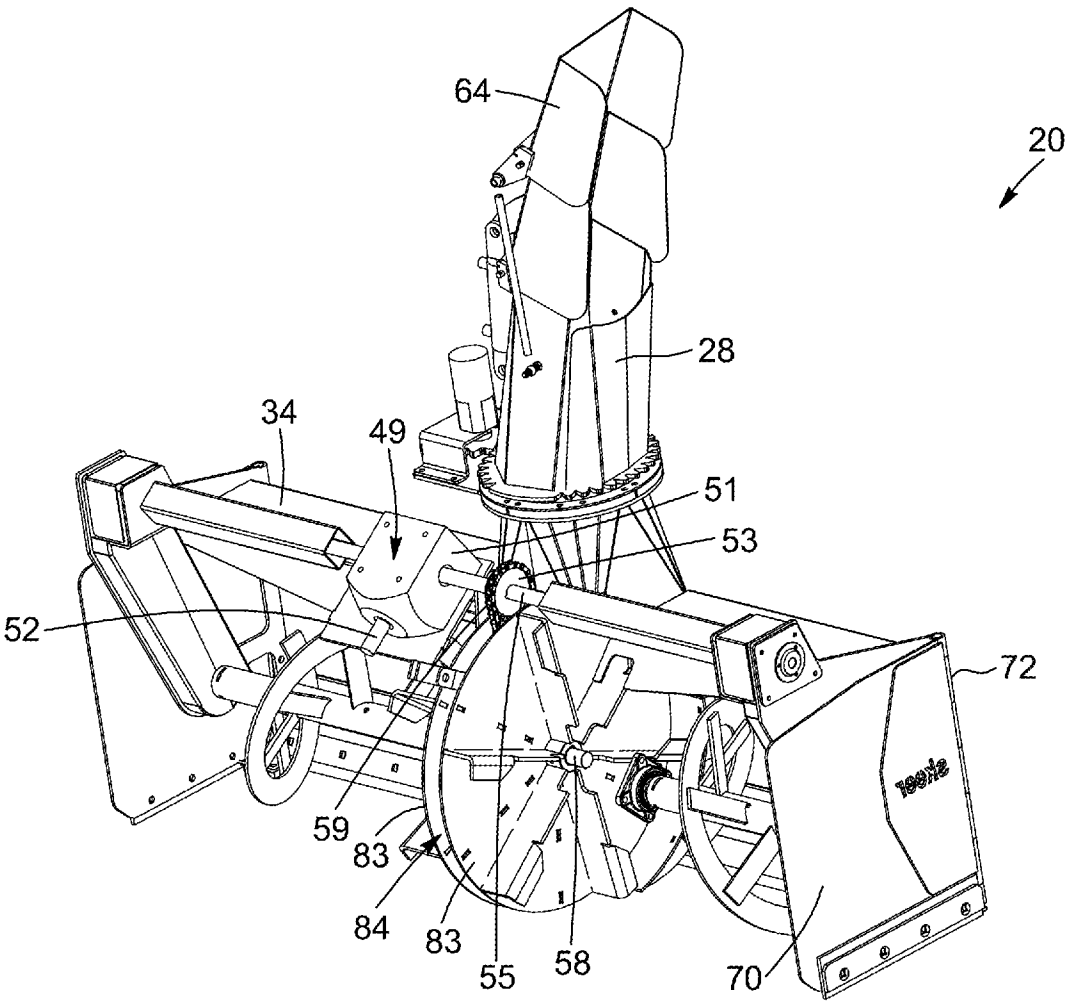
FIG. 11 is a right-side and rear perspective view of the snowblower shown in FIG. 10.

In the embodiment shown, the impeller assembly 26 is mounted to the snowblower frame 22 and comprises one or more snow-expelling devices 44 (for instance a plurality of paddles in the embodiment shown) rotatable about an impeller rotation axis X2 (FIGS. 9 and 10) at an impeller revolution speed. It is understood that the present disclosure is not limited to an impeller assembly comprising paddles; the impeller assembly could comprise any other type of snow-impelling devices, such as blades and the like. The impeller rotation axis X2 extends substantially parallel to the auger rotating axis X1 and substantially parallel to the transversally extending portion 34 of the snowblower frame 22 (i.e. substantially parallel to the longitudinal direction of the snowblower 20). The impeller assembly 26 comprises an impeller driving shaft 58—or impeller rotating axle 58—supporting the plurality of paddles 44 and rotating about the impeller rotating axis X2.

In the first embodiment shown, in FIGS. 1 to 14, the impeller driving shaft 58 extends parallel to the rotating axles 38—or auger rotating axles 38—of the auger assembly 24 and is spaced apart therefrom. In other words, the at least one rotating axle 38 of the auger assembly 24 and the impeller assembly 26 are not concentric but extend parallel to and spaced apart from one another.

Figure 12:
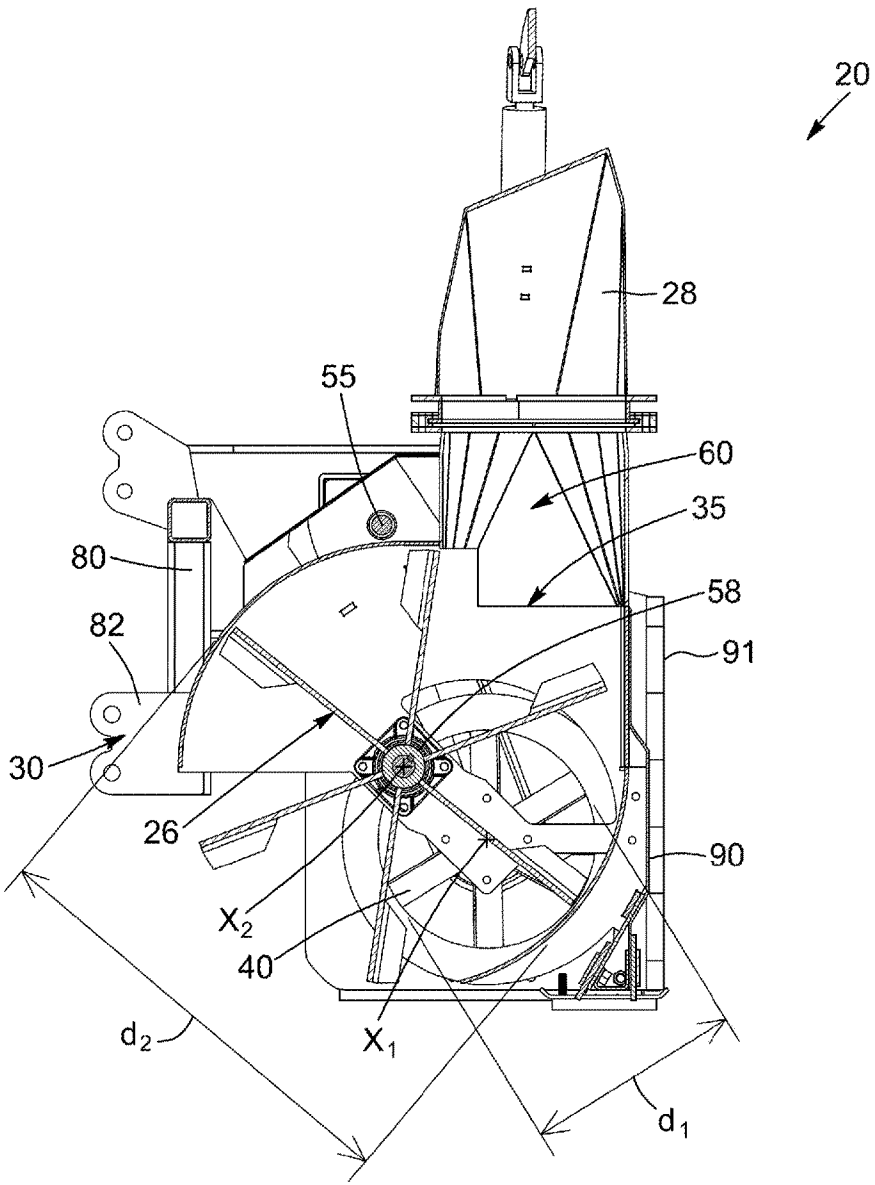
FIG. 12 is a cross-sectional view of the snowblower shown in FIG. 3 along section lines 12-12.

The transversally extending portion 34 of the snowblower frame 22 comprises an auger-facing side 90 and an opposed snowplowing side 91. As best shown in FIG. 12, the impeller rotation axis X2 extends at least one of above the auger rotation axis X1 and further from the auger-facing side 90 of the transversally extending portion 34 than the auger rotation axis X1, when the snowblower 20 is in use (i.e. when supported on a ground surface). In other words, in the embodiment shown, the impeller rotation axis X2 extends rearwardly with respect to the auger rotation axis X1. In yet other words, the impeller rotating axle 58—or impeller driving shaft 58—extends parallel to the auger rotating axles 38 but upwardly and rearwardly, i.e. closer to the vehicle attachment assembly 30.

Thus, the impeller assembly 26 is mounted between the two helical screw segments 40—or two snow-gathering devices 40—of the auger assembly 24. the impeller assembly 26 includes its own rotating axle 58 (or impeller driving shaft 58), which is spaced-apart from the auger rotating axles 38.

Since the impeller rotating axle 58 is located at least one of upwardly and rearwardly with respect to the rotating axles 38 of the auger assembly 24, the impeller assembly 26 is characterized by a diameter d2 greater than an auger diameter of a snowblower. Therefore, since the paddles 44 extend at substantially a same height than the helical screw segments 40 of the auger assembly 24 with respect to the ground surface in a lower portion of the snowblower 20, each one of the paddles 44 is longer in comparison with a snowblower wherein the impeller and auger rotating axes would be substantially concentric (as in the second embodiment represented in FIGS. 15 to 20).

Moreover, due to the relative arrangement of the impeller and auger rotating axes X2, X1, the impeller diameter d2 is greater than or equal to an auger diameter d1 of the auger assembly 24, allowing thereby to throw snow at a greater distance and/or to efficiently throw snow directed towards the impeller assembly 26 by the first and second snow-gathering devices 40 extending on both sides of the impeller assembly 26. For instance, the diameters d1, d2 correspond substantially and respectively to a span of the auger and impeller assemblies 24, 26 considered in a plane substantially transversal (for instance substantially perpendicular) to the respective auger and impeller rotation axes X1, X2.

In the embodiment shown, the impeller diameter d2 is at least about 20% greater than the auger diameter d1. In another embodiment, the impeller diameter d2 is at least about 50% greater than the auger diameter d1. In another embodiment, the impeller diameter d2 is at least about 80% greater than the auger diameter d1. In yet another embodiment, the impeller diameter d2 is at least two times greater than the auger diameter d1.

Furthermore, in the embodiment shown, the impeller assembly 26 is divided into two sections 83, each section including its own paddles 44 extending radially from the impeller rotating axle 58. The two sections 83—or impeller sections 83 or snow-impelling devices 83—are spaced apart from one another and define therebetween a transmission assembly-receiving gap 84 which is shaped and dimensioned to receive at least partially a transmission assembly 50, as will be described in more details below.

Actuator Assembly

As best shown in FIGS. 10, 11, 13 and 14, the snowblower 20 further includes an actuator assembly 49, for instance including the transmission assembly 50, the actuator assembly 49 being configured to engage the auger assembly 24 and the impeller assembly 26 simultaneously in rotation respectively about the auger and impeller rotating axes X1, X2 wherein the impeller revolution speed is greater than the auger revolution speed. In other words, the actuator assembly 49 is configured to engage simultaneously in rotation the at least one rotating axle 38—or auger rotating axle 38—of the auger assembly 24 and the plurality of paddles 44 of the impeller assembly 26 and in a manner such that the revolution speed of the impeller assembly 26 can differ from the revolution speed of the auger assembly 24 (for instance in a manner such that the impeller revolution speed is greater than the auger revolution speed). In the embodiment shown, the transmission assembly 50 includes a plurality gears operatively connected together.

Figure 13:
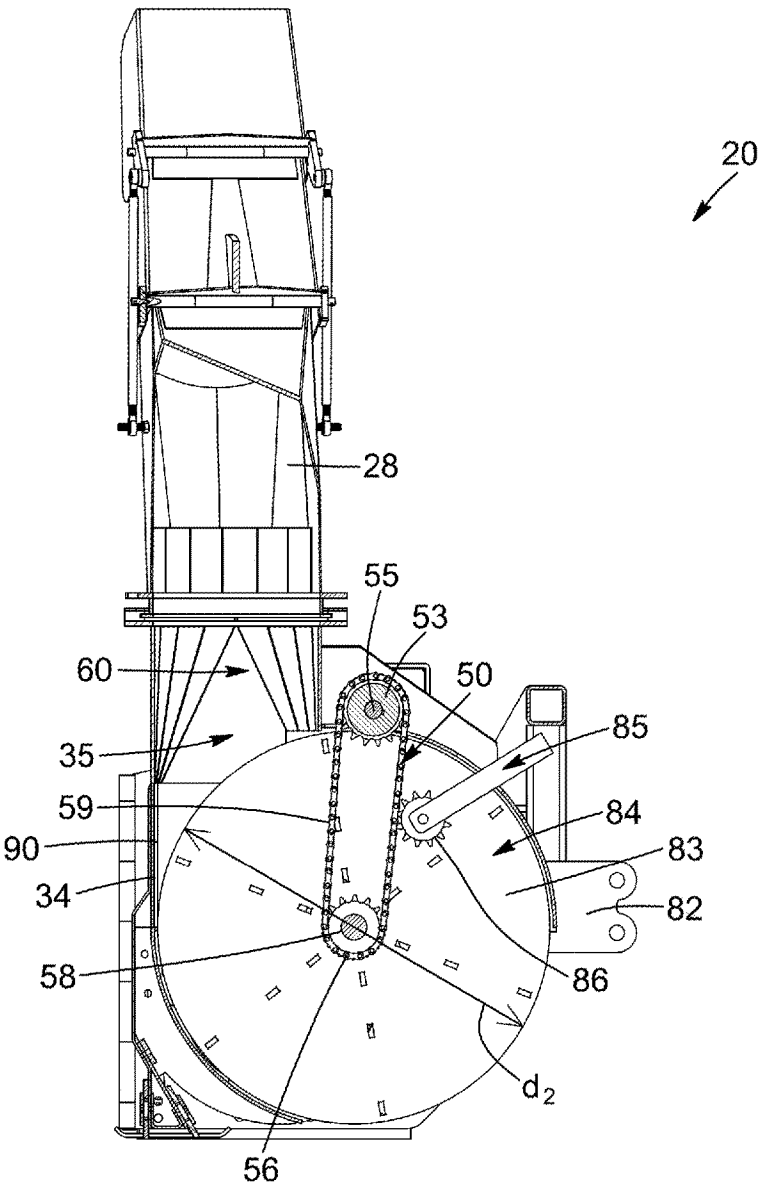
FIG. 13 is a cross-sectional view of the snowblower shown in FIG. 3 along section lines 13-13.
Figure 14:
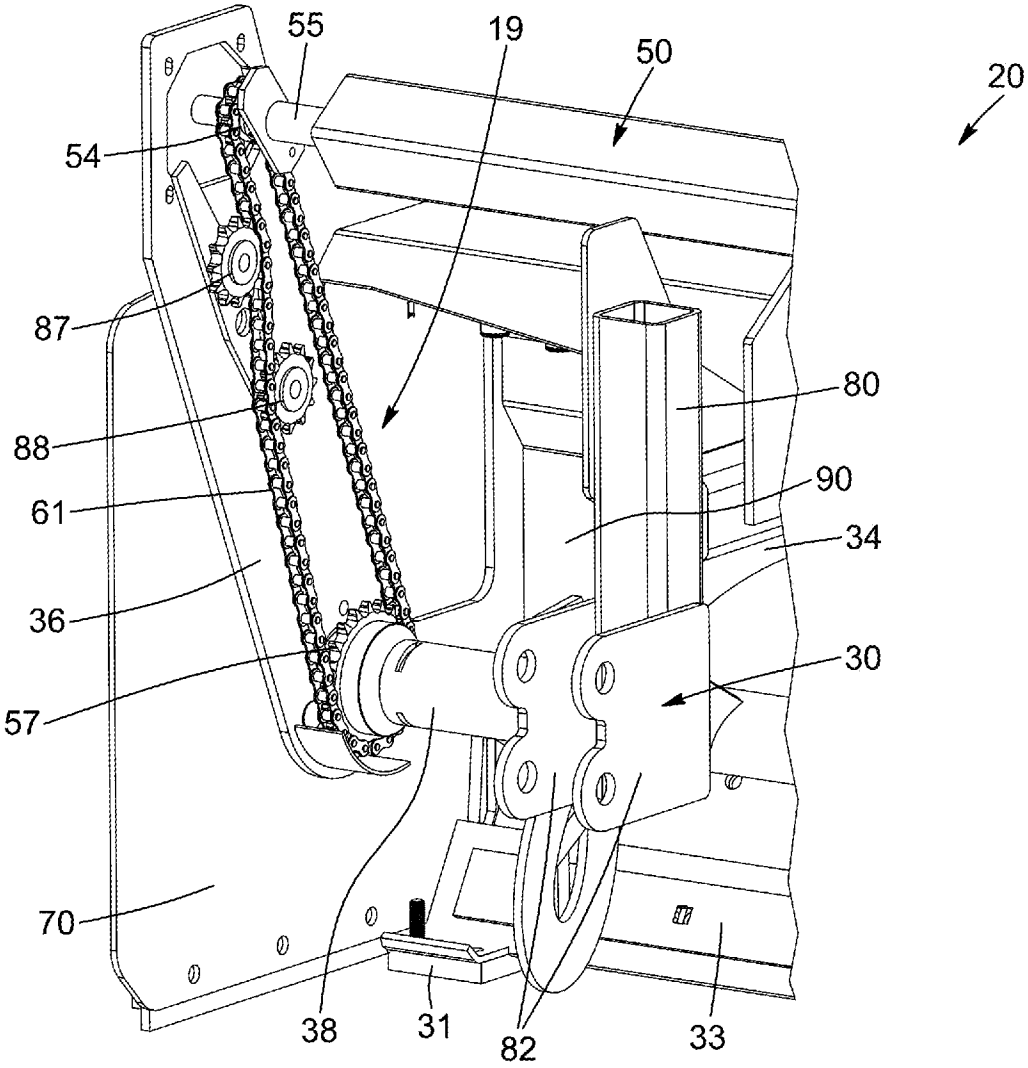
FIG. 14 is a side perspective view of a transmission assembly operatively connected to an auger rotating axle of the snowblower of FIG. 3.
Figure 15:
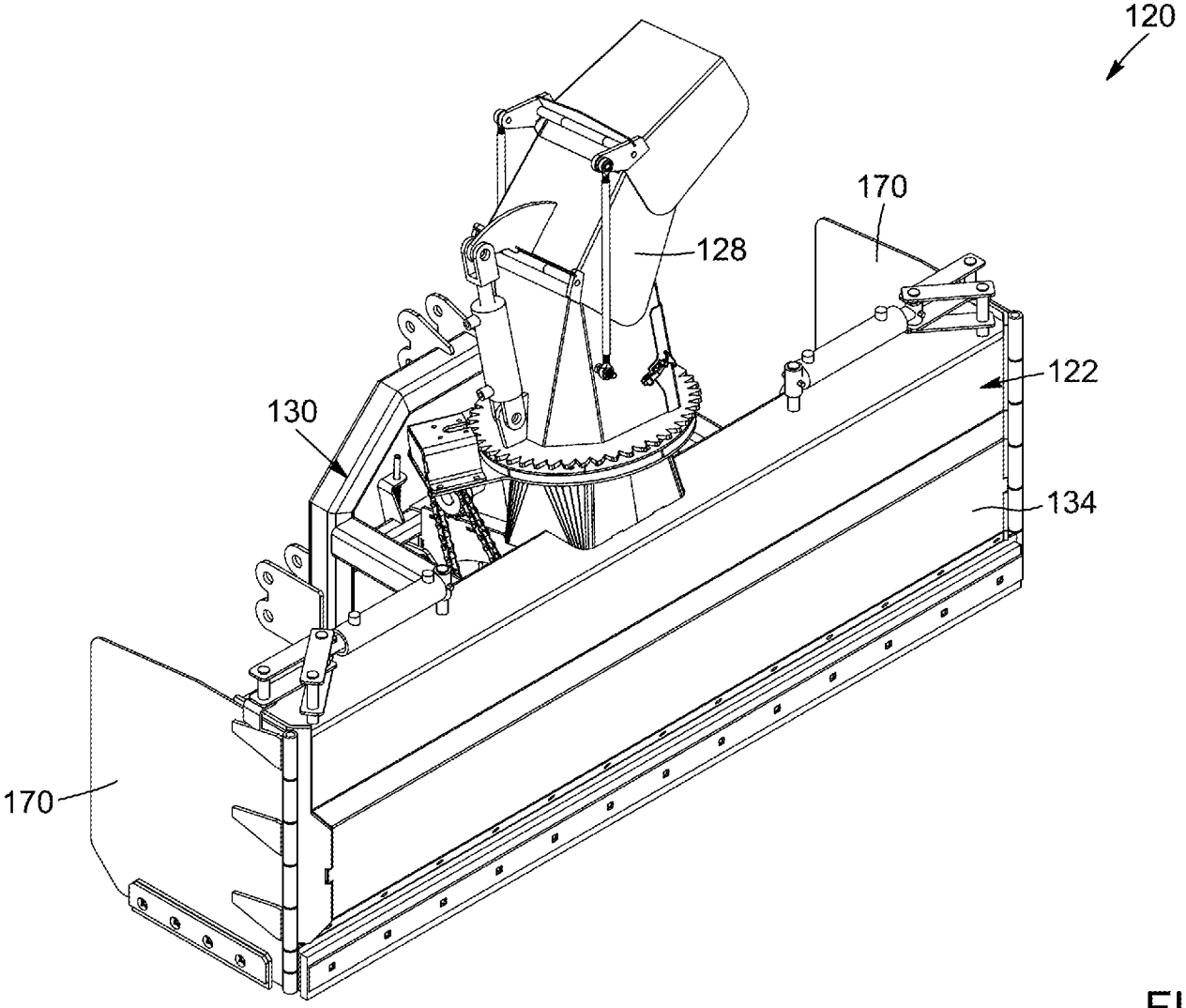
FIG. 15 is a front perspective view of a snowblower in accordance with a second embodiment, including two wings pivoted rearwardly and extending substantially perpendicular to a transversally extending portion of a snowblower frame, the snowblower comprising concentric impeller and auger rotation axes.
Figure 16:
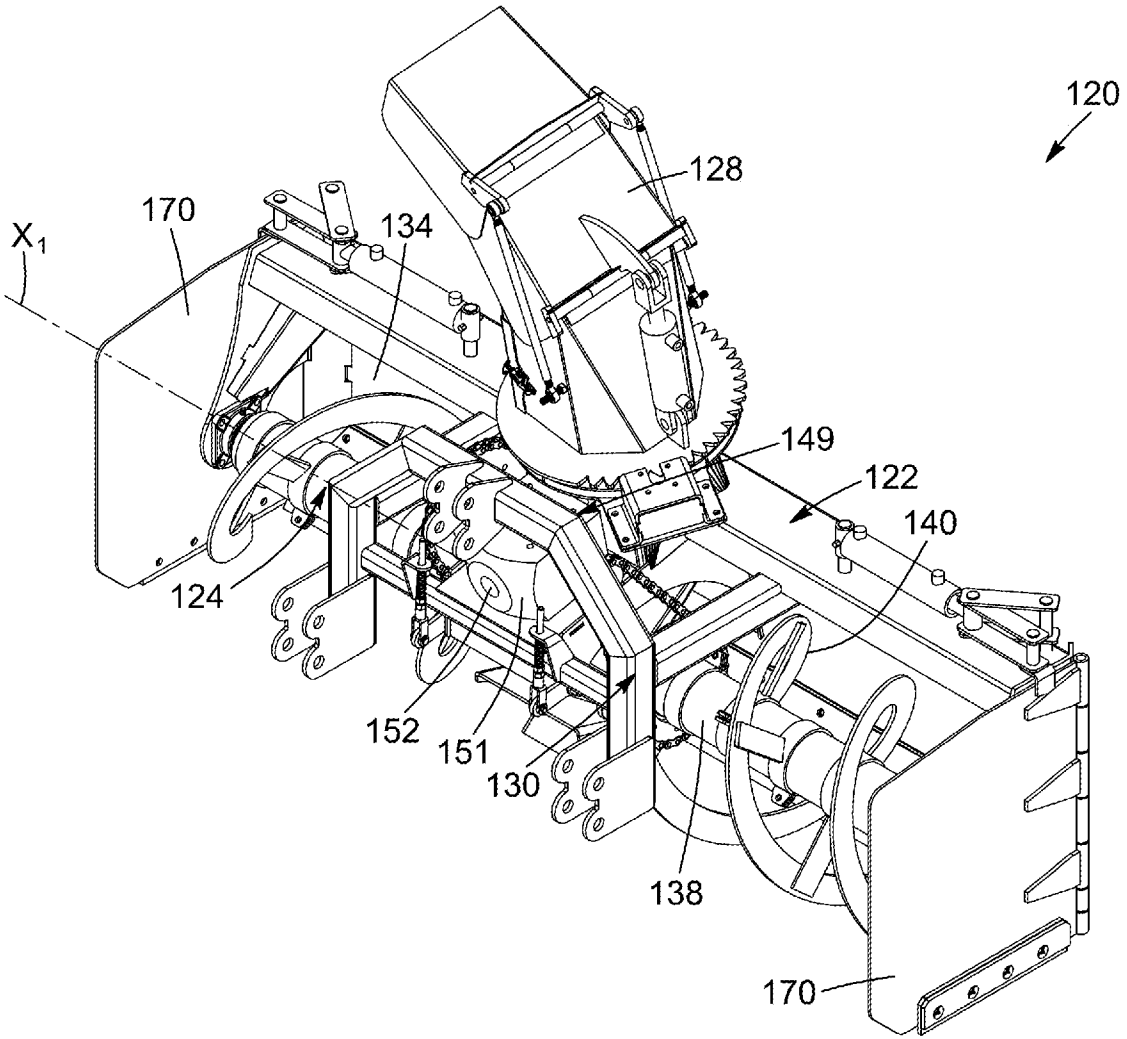
FIG. 16 is a rear perspective view of the snowblower shown in FIG. 15.
Figure 17:
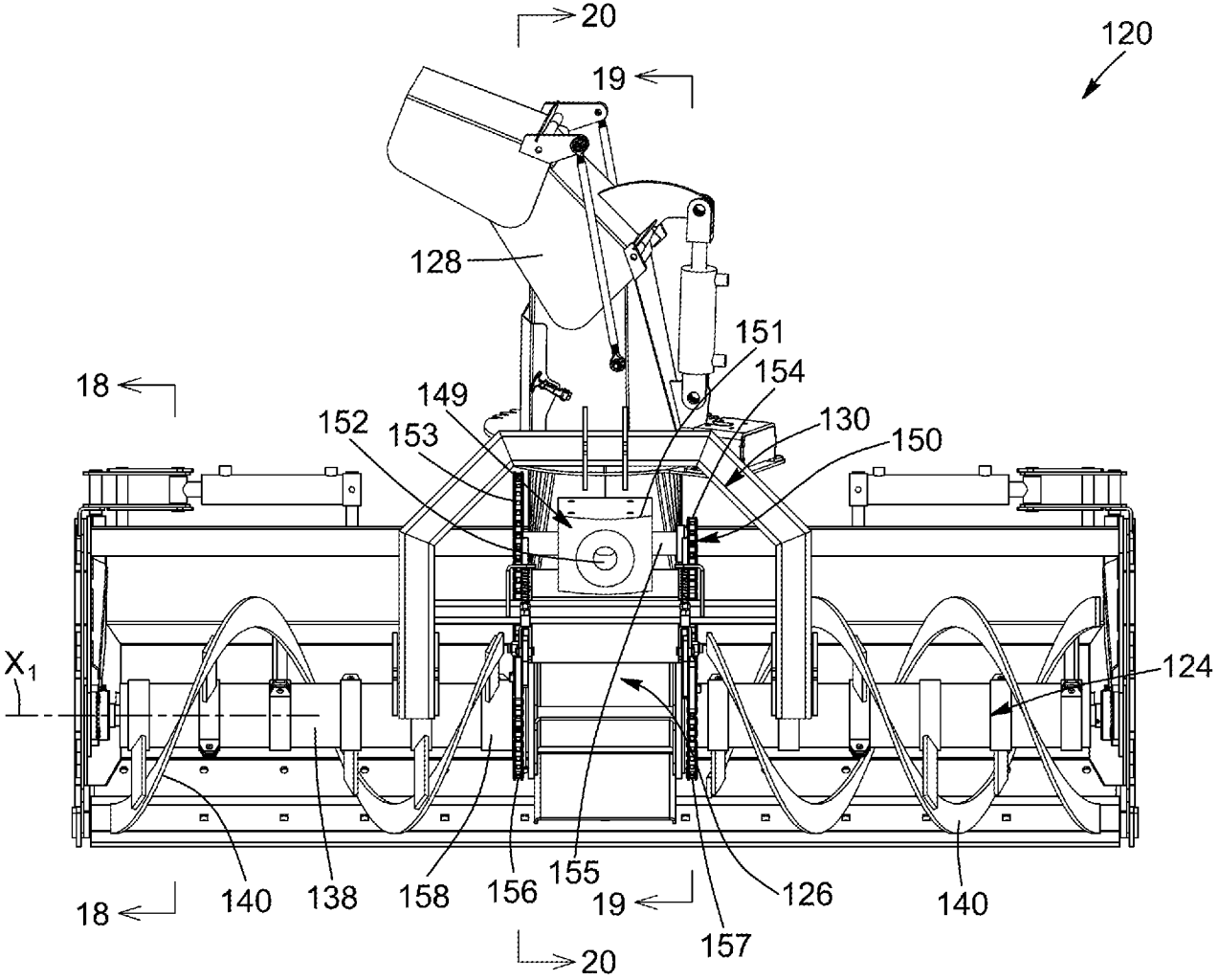
FIG. 17 is a front elevation view of the snowblower of FIG. 15.
Figure 18:
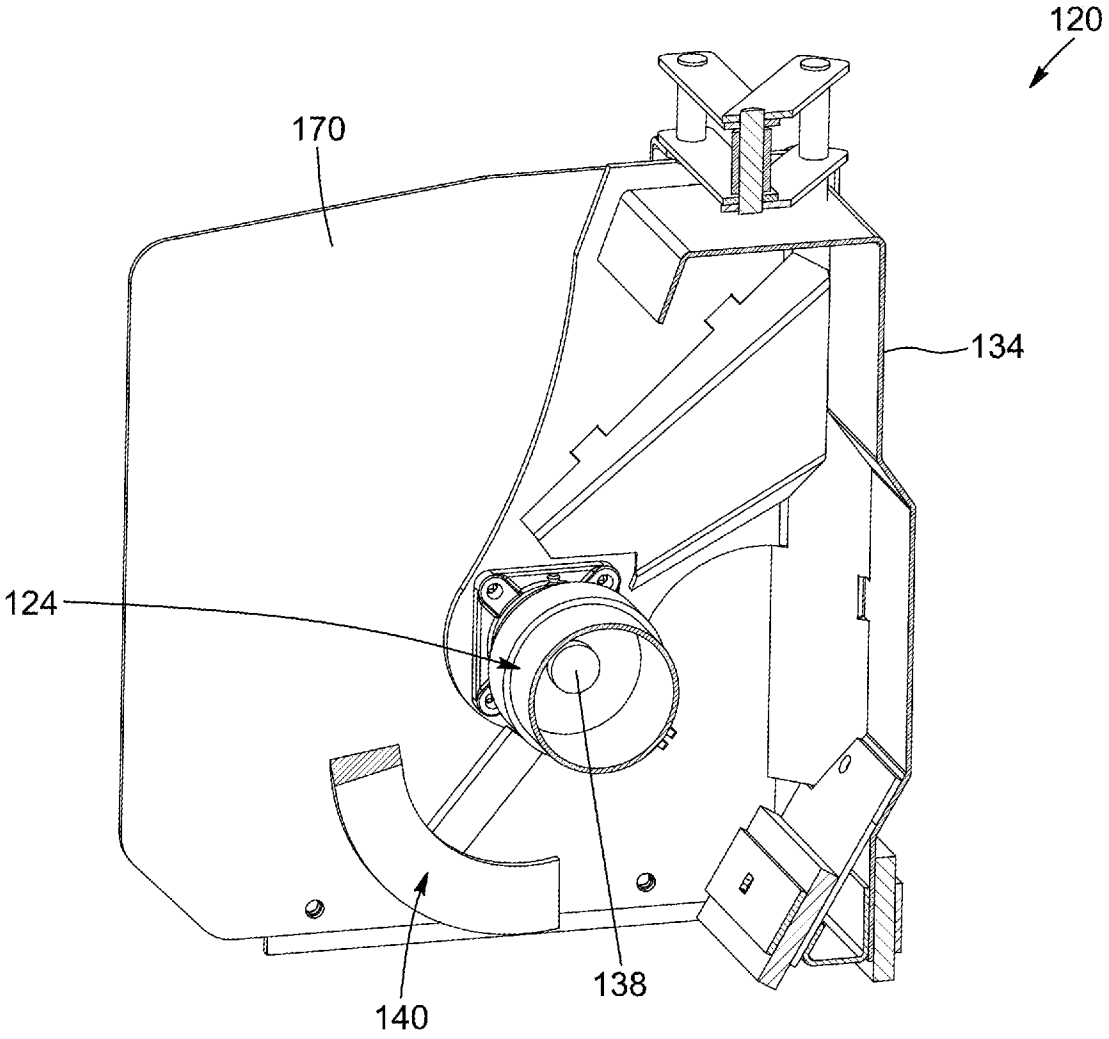
FIG. 18 is a cross-sectional view of the snowblower shown in FIG. 17 along section lines 18-18.

More particularly, referring to FIGS. 10, 11, 13 and 14, there is shown that the transmission assembly 50 includes a rotating power source 51 with a PTO shaft connector 52; the transmission assembly 50 further comprises a gearbox with an impeller driving gear 53 and at least one auger driving gear 54 (FIG. 14).

As best shown in FIG. 13, the impeller driving gear 53 is operatively connected to an impeller driven gear 56 mounted to the impeller rotating axle 58 through a chain 59 and the impeller driving gear 53 is operatively engaged with a first transmission driving shaft 55 extending along the frame 22 from the rotating power source 51. In the embodiment shown, the impeller driven gear 56, the impeller driving gear 53 and the impeller chain 59 operatively connecting the impeller driven gear 56 and the impeller driving gear 53 form together an impeller transmission subassembly of the transmission assembly 50 and are in a substantially vertical plane when the longitudinal direction of the snowblower 20 is substantially horizontal. The plane containing the impeller driven gear 56, the impeller driving gear 53 and the impeller chain 59 is axially (considered along the longitudinal direction of the snowblower 20) offset with respect to the rotating power source 51 and/or the PTO shaft connector 52. In the embodiment shown, the impeller driven gear 56, the impeller driving gear 53 and the impeller chain 59 operatively connecting the impeller driven gear 56 and the impeller driving gear 53 are located between the two snow-gathering devices 40 of the auger assembly 24. Moreover, in the embodiment shown, the impeller driven gear 56, the impeller driving gear 53 and the impeller chain 59 are located between the two sections 83 of the impeller assembly 26 (i.e. extend at least partially in the transmission assembly-receiving gap 84 formed between the two sections 83 of the impeller assembly 26).

As best shown in FIG. 13, the snowblower 20 further comprises a chain-tensioning assembly 85 comprising a tensioning sprocket 86—or tensioning gear 86—in contact with the impeller chain 59 so as to ensure an adequate tension thereto. For instance, the tensioning assembly 85 is mounted to the snowblower frame 22 or to an impeller-feeding hood 29 covering at least partially the impeller assembly 26.

In the embodiment shown, the transmission assembly 50 comprises first and second transmission driving shafts 55 extending along the frame 22 on both sides of the rotating power source 51 and/or the PTO shaft connector 52. In the embodiment shown, the first and second transmission driving shafts 55 extend substantially parallel to the transversally extending portion 34 of the frame 22 and substantially parallel to the auger and impeller rotating axes X1, X2 (i.e. along the longitudinal direction of the snowblower 20).

In the embodiment shown, the first and second helical screw segments 40 of the auger assembly 24 have a similar shape, so that the following description of the connection between the transmission assembly 50 and one of the segments 40 of the auger assembly 24 will apply to both of them.

As best shown in FIG. 14, the auger driving gear 54 is operatively engaged with one of the first and second transmission driving shafts 55 extending along the frame 22. The auger driving gear 54 is operatively engaged with an auger driven gear 57 mounted to a respective one of the two rotating axles 38 of the auger assembly 24 through an auger chain 61. Moreover, as best shown in FIG. 14, the transmission assembly 50 further comprises tensioning gears 87, 88—or tensioning sprockets 87, 88—in contact with the auger chain 61 so as to ensure an adequate tension thereto. The auger driven gear 57, the auger driving gear 54 and the auger chain 61 operatively engaging the auger driving and driven gears 54, 57 with each other form an auger transmission subassembly of the transmission assembly 50. In the embodiment shown, the auger transmission subassembly is mounted to one of first and second longitudinal ends of the auger assembly 24. Due to the arrangement of the auger transmission subassembly, an obstruction of the discharge chute inlet 60 by the transmission assembly is thus limited.

Therefore, actuation of the rotating power source 51 of the transmission assembly 50 engages the two rotating axles 38 and the impeller rotating axle 58 in rotation simultaneously. In the embodiment shown, the impeller and auger driven gears 56, 57 have substantially the same diameter and number of teeth; the impeller driving gear 53 has a diameter larger than a diameter of the auger driving gear 54 and/or has more teeth than the auger driving gear 54. In the embodiment shown, since the impeller driving gear 53 includes more teeth and/or is of a larger diameter than the auger driving gear 54, the impeller revolution speed is greater than the auger revolution speed, even though the auger and impeller assemblies 24, 26 are engaged in rotation by the same rotating power source 51.

In alternative embodiments, the impeller and auger driven gears 56, 57 could be of different diameter and/or number of teeth. Thus, the transmission ratio can vary from the one shown in the figures. In other words, the transmission assembly can define a variable speed ratio between the impeller revolution speed and the auger revolution speed.

As the gear ratio can be adjusted, it is possible to engage the impeller rotating axle 58 in rotation at a different revolution speed than a revolution speed of the rotating axles 38. More particularly, the transmission assembly 50 can be configured to provide a revolution speed increase between the revolution speed of the rotating axles 38 (i.e. the revolution speed of the two helical screw segments 40) and the revolution speed of the impeller assembly 26.

It is appreciated that the transmission assembly 50 can vary from the embodiment shown. For instance, the auger and impeller transmission subassemblies could be arranged differently with respect to the transversally extending portion 34 (i.e. the first and second transmission driving shafts 55 operatively connecting the rotating power source 51 to the impeller and auger assemblies 26, 24 could have other shapes and/or dimensions). The transmission assembly 50 can be either a variable transmission assembly, which can be controlled by the snowblower operator, or have a fixed ratio, such as a gear ratio. It is appreciated that the transmission assembly can include a belt and pulley transmission instead of gear(s).

In the embodiment shown, the transmission assembly 50 (the rotating power source 51 thereof) is engaged in rotation via a shaft, such as a power take-off (PTO) shaft, powered by the vehicle, such as a tractor. In another embodiment, the transmission assembly 50 can be engaged via a hydraulic, an electric or an hybrid actuator.

In the embodiment shown, the actuator assembly 49 is configured (for instance the different components of the transmission assembly 50 are shaped and dimensioned) so that the rotating axles 38 and, thereby, the snow-gathering devices 40 of the auger assembly 24, can revolution at an auger revolution speed ranging between about 125 RPM to about 250 RPM. Through the transmission assembly 50, the impeller revolution speed of the impeller assembly 26 can be increased to about 400 RPM to about 800 RPM.

In the embodiment shown, a ratio between the impeller revolution speed and the auger revolution speed is comprised between about 1.5 and about 8.

In the embodiment shown, the rotation axes X1, X2 of the auger assembly 24 and the impeller assembly 26 are substantially perpendicular to a displacement axis of the vehicle to which the snowblower is mounted to and/or substantially parallel to the transversally extending portion 34 of the frame 22.

Figure 8:
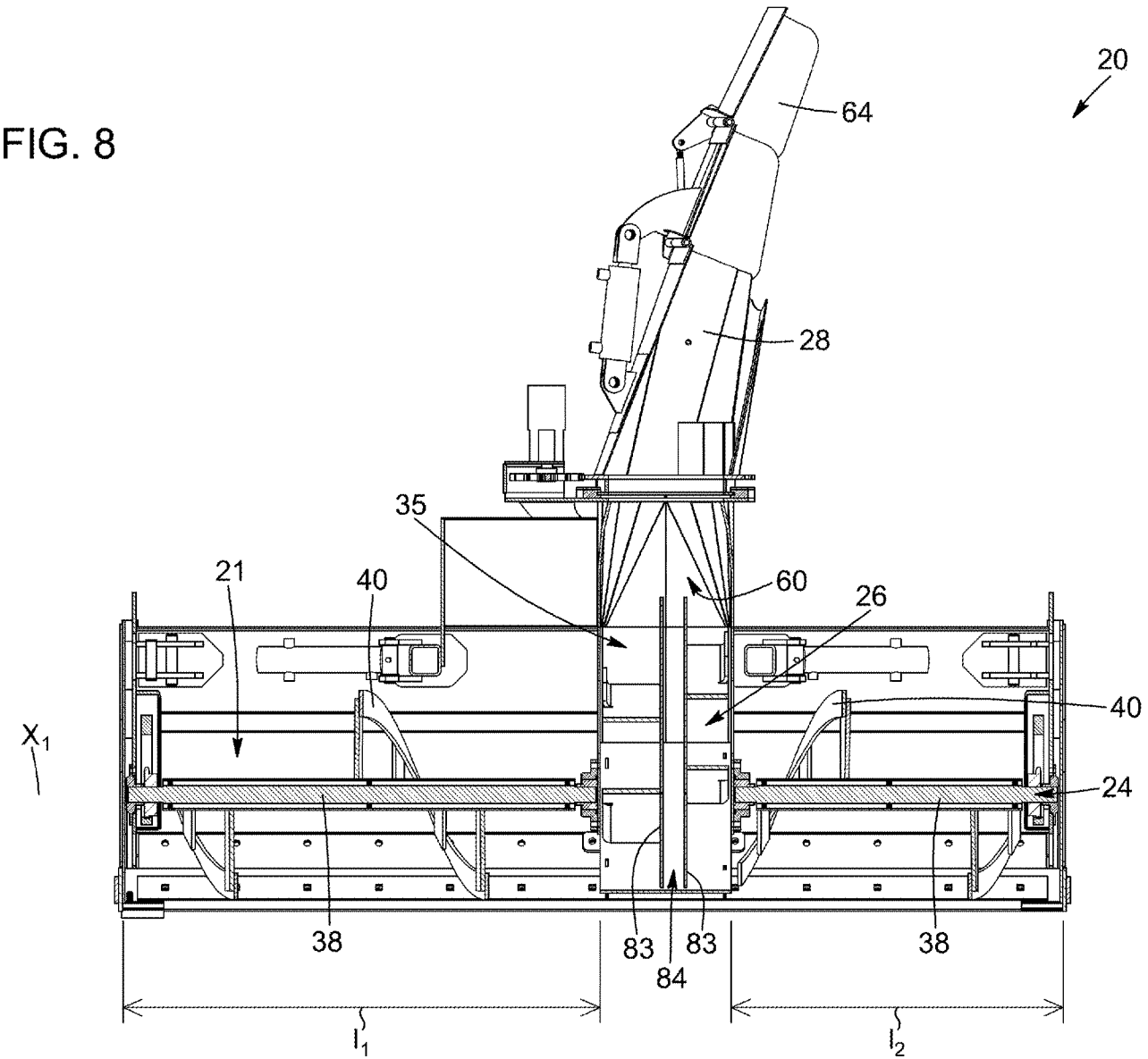
FIG. 8 is a cross-sectional view of the snowblower shown in FIG. 3 along section lines 8-8.

In the embodiment shown, as best shown for instance in FIG. 8, the first and second auger rotating axles 38 have a different length, considered along the transversally extending portion 34: a length 11 of one of the auger rotating axles 38 is greater than a length l2 of the other auger rotating axle 38.

Figure 21:
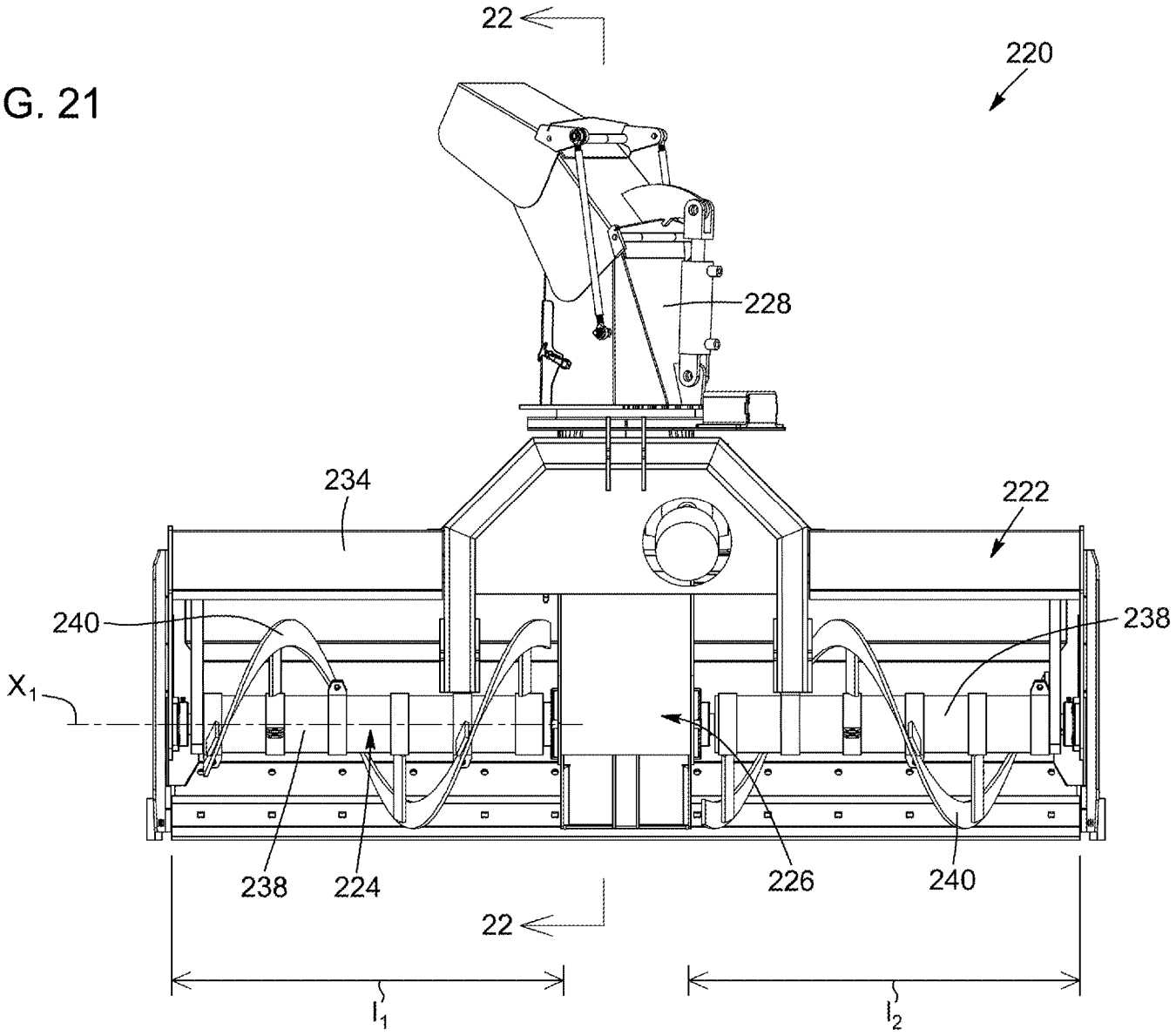
FIG. 21 is a front elevation view of a snowblower in accordance with a third embodiment, the snowblower comprising impeller and auger rotation axes parallel and spaced apart from each other, an auger assembly of the snowblower having a substantially vertical plane of symmetry.
Figure 22:
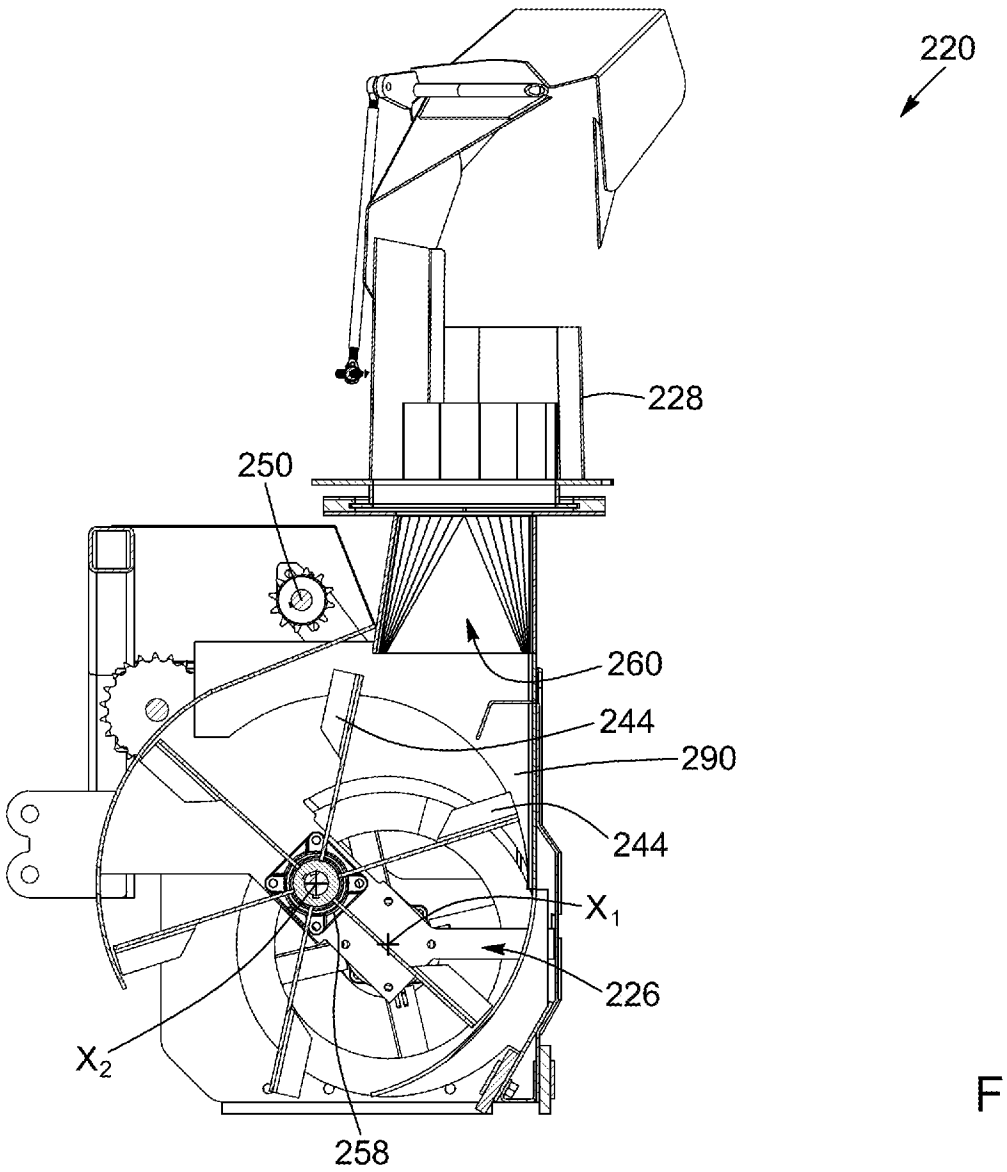
FIG. 22 is a cross-sectional view of the snowblower of FIG. 21 along section lines 22-22.

As represented in FIGS. 21 and 22, it could also be conceived a snowblower 220, as in the first described embodiment, comprising a snowblower frame 222 with a transversally extending portion 234; an auger assembly 224 mounted to the snowblower frame 222 and comprising at least one rotating axle 238 extending substantially parallel to the transversally extending portion 234 and at least one snow-gathering device 240 mounted to the at least one rotating axle 238 and rotating therewith about an auger rotating axis X1 at an auger revolution speed; an impeller assembly 226 mounted to the snowblower frame 222 and comprising a plurality of paddles rotatable 244 about an impeller rotation axis X2 at an impeller revolution speed, the impeller rotation axis extending substantially parallel to the auger rotating axis; an actuator assembly 250 configured to engage the auger assembly 224 and the impeller assembly 226 in rotation wherein the impeller revolution speed is greater than the auger revolution speed; and a discharge chute 228 mounted to the snowblower frame 222 and having a discharge chute inlet 260 adjacent to the impeller assembly 226. Similarly to the first described embodiment, the impeller assembly 226 comprises an impeller driving shaft 258, the plurality of paddles 244 being supported thereby and rotating therewith. The impeller driving shaft 258 extends parallel to the at least one rotating axle 238 and is spaced apart therefrom.

In the embodiment shown, the auger assembly 224 comprises two rotating axles 238, concentric and spaced-apart from each other and two snow-gathering devices 240 mounted to a corresponding one of the two rotating axles 238. The impeller driving shaft 258 extends between the two rotating axles 238 (or auger rotating axles 238). The impeller rotation axis X2 extends above the auger rotation axis X1 and further from an auger-facing side 290 of the transversally extending portion 234 than the auger rotation axis X1, when the snowblower 220 is in use.

As best shown in FIG. 21, the first and second auger rotating axles 238 have a substantially similar length 11, 12, considered along the transversally extending portion 234. In other words, the impeller assembly 226 is arranged substantially centrally with respect to a length of the transversally extending portion 234. In yet other words, the snowblower 220 (or at least the auger assembly 224 thereof) has a substantially vertical plane of symmetry extending substantially perpendicularly to the auger and impeller rotation axes X1, X2 and substantially perpendicularly to the transversally extending portion 234 of the snowblower frame 222.

Pivoting Lateral Wings

Figure 3:
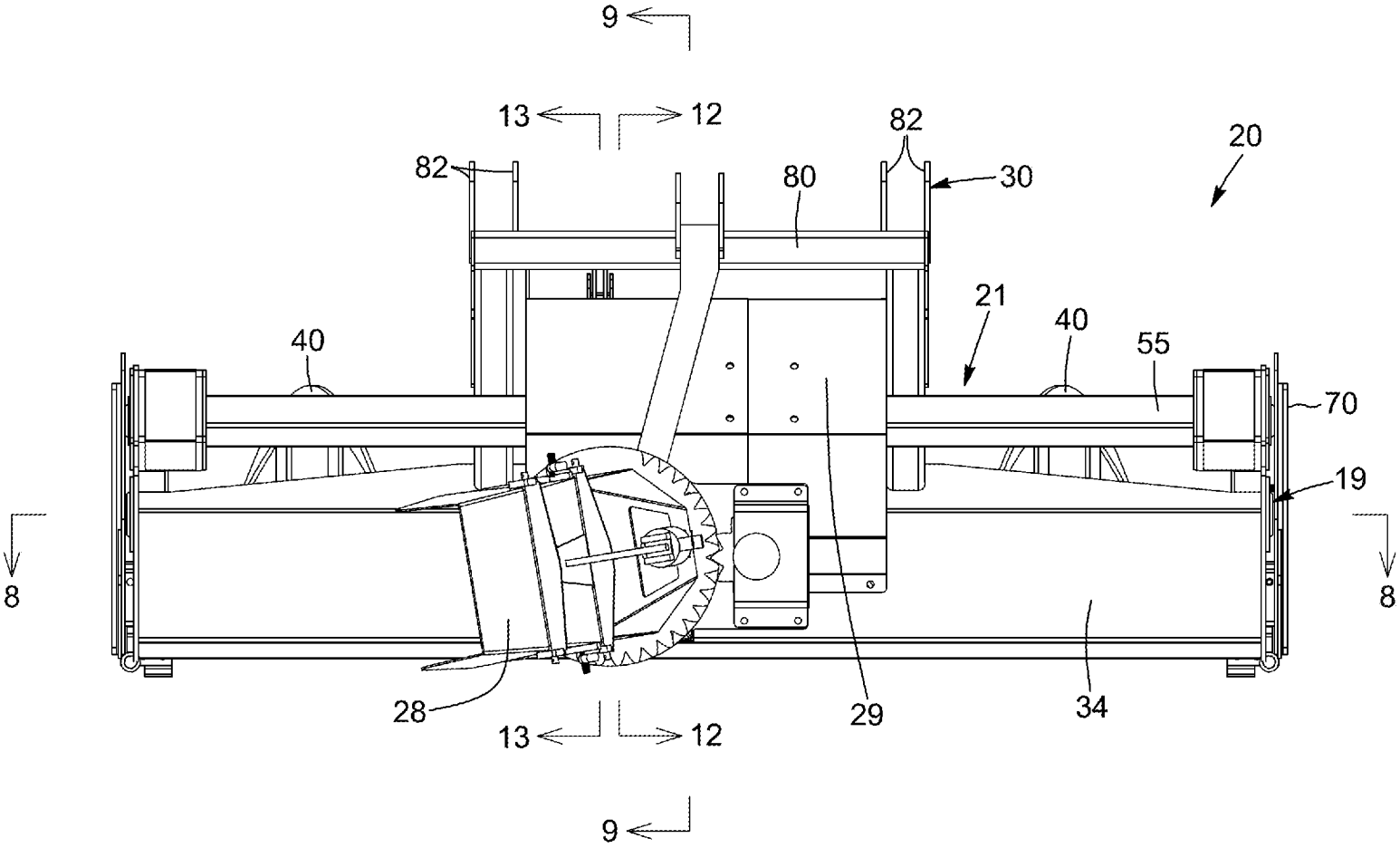
FIG. 3 is a top plan view of the snowblower shown in FIG. 1.
Figure 4:
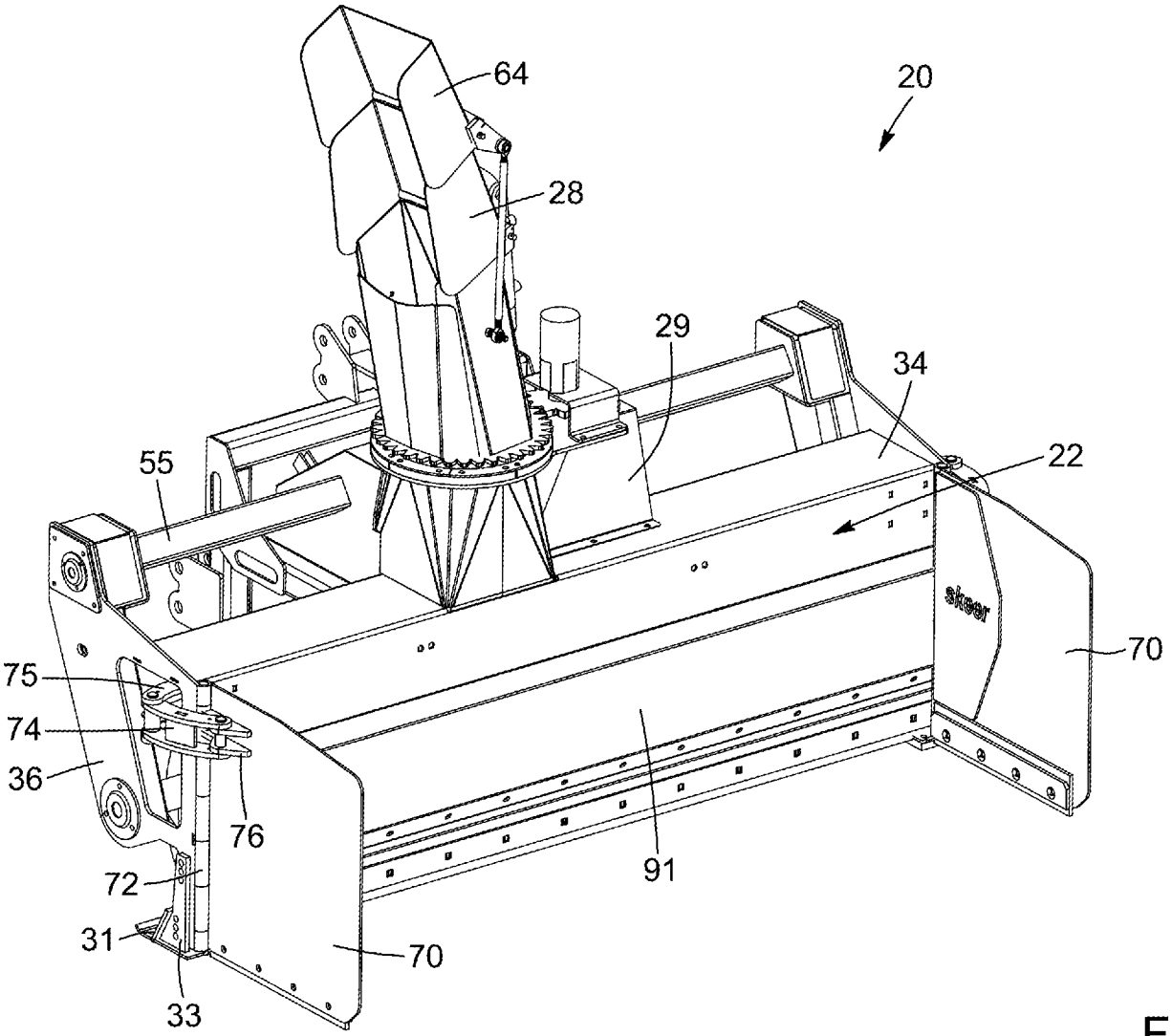
FIG. 4 is a front perspective view of the snowblower shown in FIG. 1, wherein the two wings are pivoted forwardly and extend substantially perpendicular to the transversally extending portion of the snowblower frame.
Figure 5:
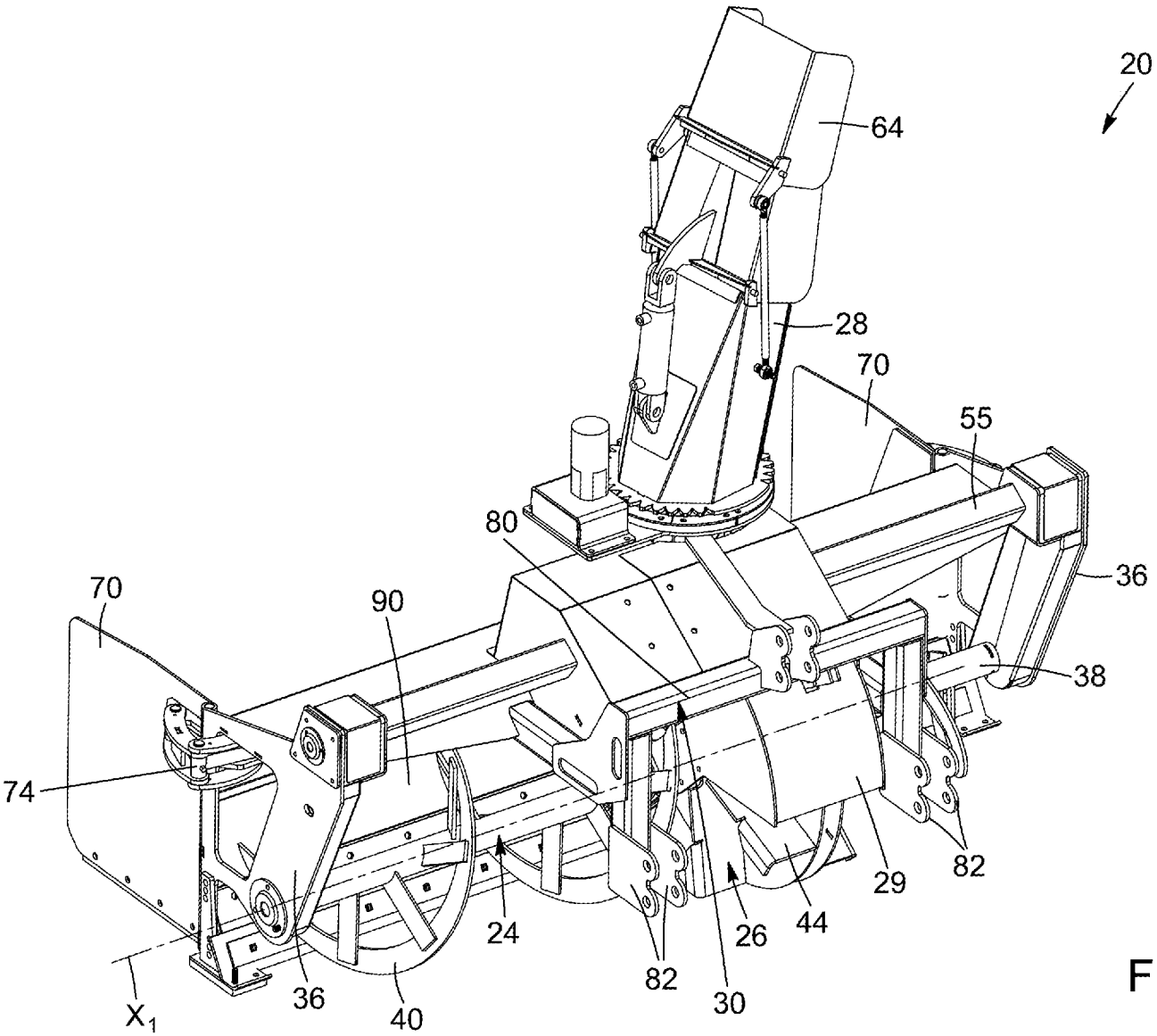
FIG. 5 is a rear perspective view of the snowblower shown in FIG. 4.
Figure 6:
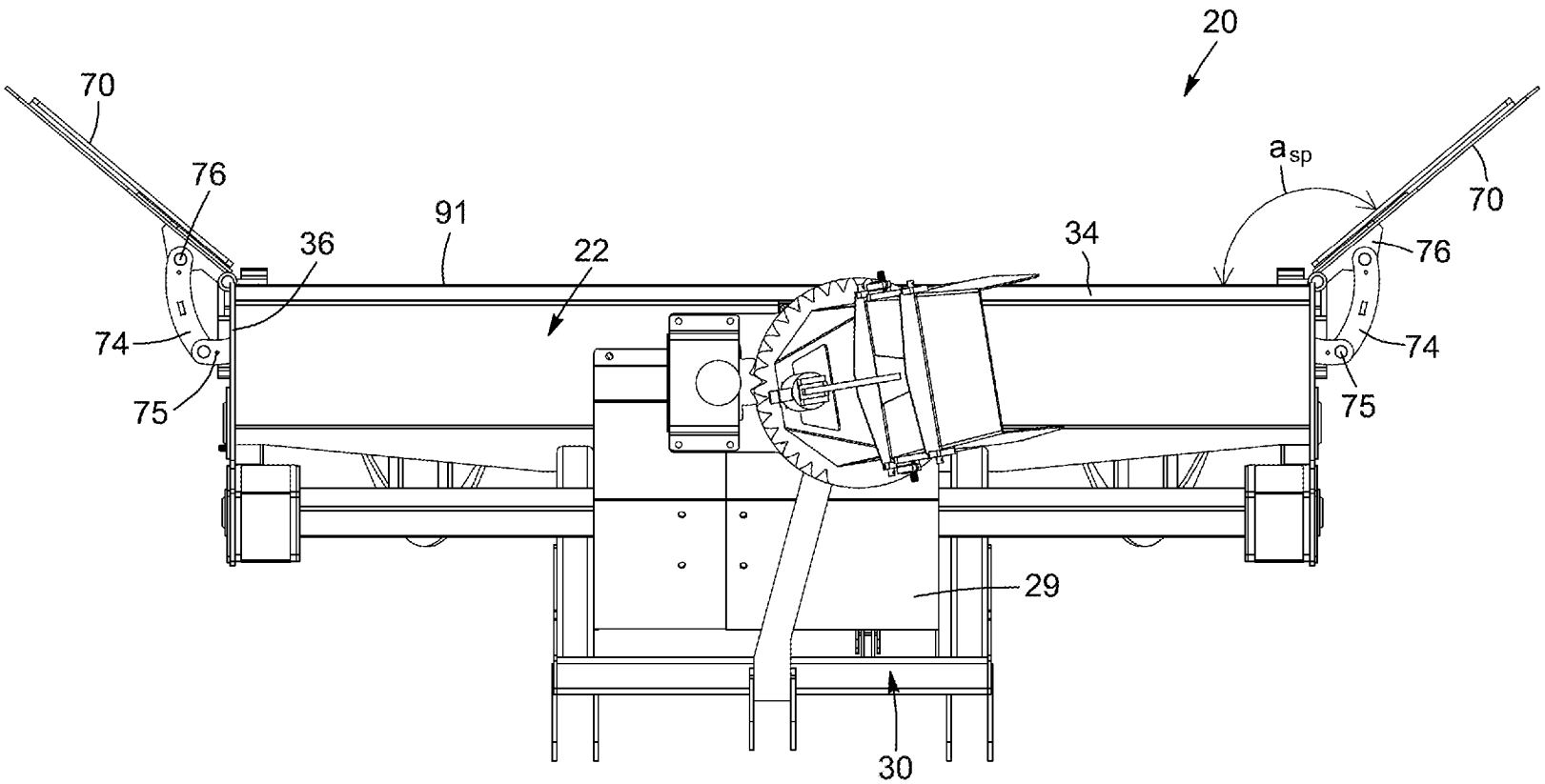
FIG. 6 is a top plan view of the snowblower shown in FIG. 1, wherein the two wings are pivoted forwardly and extend at an oblique angle with respect to the transversally extending portion of the snowblower frame.
Figure 7:
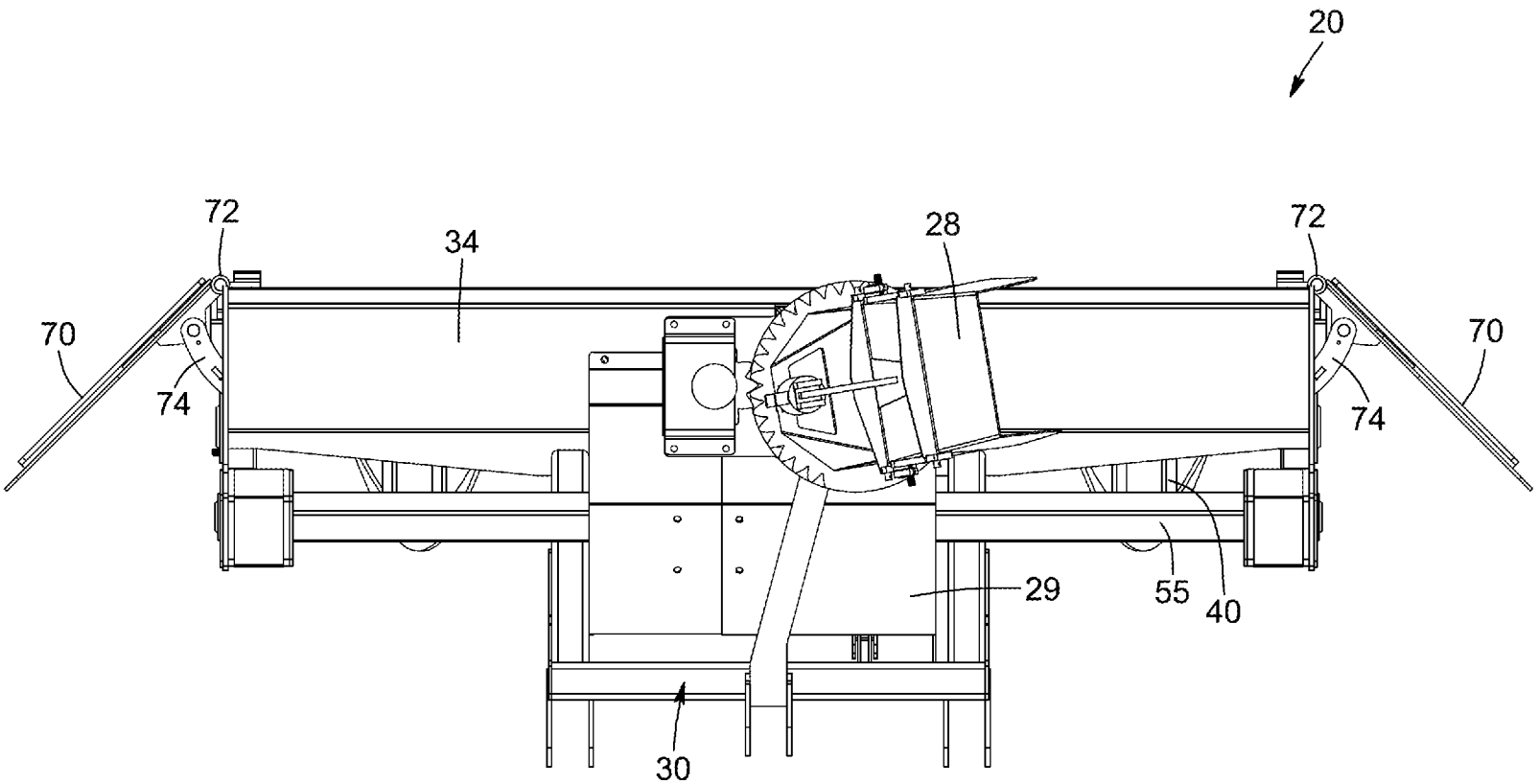
FIG. 7 is a top plan view of the snowblower shown in FIG. 1, wherein the two wings are pivoted rearwardly and extend at an oblique angle with respect to the transversally extending portion of the snowblower frame.

Returning now to FIGS. 1 to 6, in the embodiment shown, the snowblower 20 further comprises two wings 70, pivotally mounted to the transversally extending portion 34 of the frame 22, at or in the vicinity of opposed ends 37 thereof. In the embodiment shown, the pivot axis 72 of each wing 70 is located along or in the vicinity of a respective one of vertical edges 39 of the transversally extending portion 34. It is appreciated that, in an alternative embodiment, the pivot axis 72 of each wing 70 can be slightly spaced-apart from the vertical edges 39 of the transversally extending portion 34. The snowblower 20 further comprises two wing actuators 74 (FIGS. 6 and 7), having a first end 75 mounted to the snowblower frame 22 (for instance to the transversally extending portion 34 or to the axle supports 36 thereof) and a second end 76 mounted to the respective one of the wings 70, for instance adjacent to upper edges thereof. In the embodiment shown, the wing actuators include for instance hydraulic cylinders, electric actuators and/or hybrid actuators. The wing actuators 74 can be configured in a retracted configuration wherein the wings 70 extend rearwardly and substantially normal to the transversally extending portion 34 (FIGS. 1 to 3, 8 to 11) and an extended configuration wherein the wings 70 extend forwardly and substantially normal to the transversally extending portion 34 (FIGS. 4 and 5). It is appreciated that, in an alternative embodiment, the wing actuators 74 can be configured in a retracted configuration to configure the wings 70 forwardly and in the extended configuration to configure the wings 70 rearwardly. Furthermore, it is appreciated that the wings 70 can extend at any angle between the rearwardly and normal configurations (FIGS. 1 to 3, 8 to 11) and the forwardly and normal configurations (FIGS. 4 and 5). In FIGS. 6 and 7, the wings 70 extend respectively in forwardly and rearwardly extending configuration, each one defining an oblique angle with the transversally extending portion 34 of the frame 22.

With the pivoting lateral wings 70 configured in the rearwardly extending configuration, or in a direction towards the auger and impeller assemblies 24, 26, the snowblower 20 is configured in a snowblowing configuration wherein the pivoting lateral wings 70 at least partially delimit with the transversally extending portion 34 of the frame 22 (with the auger-facing side 90 thereof) an auger-containing cavity 21 (FIG. 2). It is thus understood that, when the snowblower 20 is configured in the snowblowing configuration, the lateral wings 70 and the transversally extending portion 34 of the snowblower frame 22 form together an auger and impeller housing 19 substantially U-shaped when viewed from above, as represented in FIG. 3. The auger-containing cavity 21 thus forms a snow inlet opening towards a rear portion of the snowblower 20, so as to collect snow in the auger-containing cavity 21 upon displacement of the snowblower 20 along a rearward direction R (FIG. 1) and/or actuation of the auger and impeller assemblies 24, 26.

With the wings 70 configured in the forwardly extending configuration, or in a direction opposed to the auger assembly 24, the snowblower 20 can be used as a snowplow, so that the snowblower 20 forms a combined snowblower and snowplow. In other words, with the pivoting lateral wings 70 configured in the forwardly extending direction, the snowblower 20 is configured into a snowplowing configuration wherein the wings 70 form with the snowplowing side 91 of the transversally extending portion 34 a snowplow angle $a_{sp}$ smaller than about 180 degrees (FIG. 6).

It is appreciated that, in an alternative embodiment, the wing actuators can be different from the ones shown in the figures. For instance and without being limitative, they can be powered hydraulically or electrically, it can include rotative actuator, chain and sprocket assemblies, gears, belt and pulley assemblies, hydraulic cylinders, and the like.

In the non-limitative embodiment shown, the vehicle attachment assembly 30 comprises an attachment frame 80 extending rearwardly from the transversally extending portion 34 of the frame 22, centrally thereof. In the embodiment shown, the impeller assembly 26 is contained within an internal spacing defined between the transversally extending portion 34 of the frame 22 and the attachment frame 80. In other words, the attachment frame 80 at least partially forms the auger and impeller housing 19. The vehicle attachment assembly 30 comprises two sets of attachment plates 82, spaced-apart from one another, engageable by the arms of the motorized vehicle and to which the arms of the motorized vehicle are securable. It is appreciated that the attachment assembly 30 can vary from the embodiment shown, depending on the vehicle type to which the snowblower 20 will be mounted to.

Other Features of the Snowblower

In the embodiment shown, the snowblower frame 22 (for instance the transversally extending portion 34 thereof) comprises a discharge opening 35 formed therein, for instance substantially centrally therein and/or in the vicinity of the impeller assembly 26, wherein the discharge chute inlet 60 is in fluid communication with the discharge opening 35.

The impeller assembly 26 at least partially extends in the discharge opening 35. The snow discharge chute 28 of the snowblower 20 is mounted, in the embodiment shown, to the snowblower frame 20 (for instance to the transversally extending portion 34 thereof) and extends substantially upwardly (substantially vertically in the embodiment shown) from the discharge opening 35. In the embodiment shown, the snow discharge chute 28 is pivotally mounted to the snowblower frame 22 about a substantially vertical rotation axis, so as to modify the direction of the throwing of the snow out of the snow discharge chute 28 upon actuation of the snowblower 20. Moreover, in the embodiment shown, as represented for instance in FIG. 1, the snow discharge chute 28 comprises an upper hood 64 pivotally mounted to an upper end portion of the snow discharge chute 28 about a substantially horizontal pivoting axis to adjust the direction of the throwing of the snow upon actuation of the snowblower 20. The snow discharge chute 28 defines a snow discharge cavity in fluid communication with the discharge chute inlet 60 and the discharge opening 35 formed in the snowblower frame 22, for snow collected upon displacement of the snowblower 20 and/or upon actuation of the auger assembly 24 and/or the impeller assembly 26 to be thrown to another location, via the snow discharge chute 28.

Moreover, the above-mentioned impeller-feeding hood 29 covers at least partially the impeller assembly 26 and is mounted to the snowblower frame 20 (for instance to the transversally extending portion 34 thereof). The impeller-feeding hood 29 is shaped and dimensioned to direct snow displaced by the impeller assembly 26 towards the discharge opening 35 and the discharge chute inlet 60 upon actuation of the impeller and auger assemblies 26, 24.

As best shown in FIGS. 4 and 14, the snowblower 20 further comprises a ground-contacting blade 33 mounted to a lower edge of the transversally extending portion 34 and being substantially inclined with respect to the auger-facing side 90 thereof, The ground-contacting blade 33 is shaped and dimensioned to prevent a direct contact between the lower edge of the transversally extending portion 34 and the ground surface, when the snowblower is in use. For instance, the ground-contacting blade 33 is formed in a material different than the transversally extending portion 34. For instance, the ground-contacting blade 33 is at least partially formed of rubber, urethane and/or a polymeric-based material, In the embodiment shown, the ground-contacting blade 33 has longitudinal end portions 31 forming ground-contacting hoods. For instance, as represented in FIG. 14, the pivotable wings 70 abut the longitudinal end portions 31 of the ground-contacting blade 33 when the snowblower 20 is configured in the snowblowing configuration.

Alternative Embodiment of the Snowblower—Concentric Auger and Impeller Rotating Axes Referring to FIGS. 15 to 20, there is shown an alternative embodiment of the snowblowers 20, 220 wherein the features are numbered with reference numerals in the 100 series which correspond to the reference numerals of the previous embodiments.

As the snowblower 20, 220, the snowblower 120 includes a snowblower frame 122 with a transversally extending portion 124. The snowblower frame 122 supports an auger assembly 124, an impeller assembly 126, a discharge chute 128 with a discharge chute inlet 160, and a vehicle attachment assembly 130.

Similarly to the previously described embodiments, the auger assembly 124 comprises at least one rotating axle 138 extending substantially parallel to the transversally extending portion 134 and at least one snow-gathering device 140 mounted to the rotating axle 138 and rotating therewith about an auger rotating axis X1 at an auger revolution speed. The impeller assembly 126 comprises a plurality of paddles 144 rotatable about an impeller rotation axis X2 at an impeller revolution speed, the impeller rotation axis X2 extending substantially parallel to the auger rotating axis X1. The discharge chute 128 has a discharge chute inlet 160 adjacent to the impeller assembly 126.

The snowblower 120 further comprises an actuator assembly 149 configured to engage the auger assembly 124 and the impeller assembly 126 in rotation wherein the impeller revolution speed is greater than the auger revolution speed.

In this third embodiment, the impeller rotation axis X2 is concentric with the auger rotating axis X1. In the embodiment shown, the impeller assembly 126 comprises an impeller driving shaft 158 with the plurality of paddles 144 being supported thereby and rotating therewith. The impeller driving shaft 158 is mounted to the rotating axle 138, for instance substantially centrally thereof, and is rotatable around the rotating axle 138. For instance, the impeller driving shaft 158 is mounted between the two snow-gathering devices 140 (for instance the helical screw segments 140) of the auger assembly 124. In the embodiment shown, the impeller driving shaft 158 surrounds a central portion of the auger rotating axle 138 extending between the two snow-gathering devices 140. The impeller driving shaft 158 is thus rotatable around the rotating axle 138.

In the embodiment shown, and similarly to the previously described embodiments, the actuator assembly 149 includes a transmission assembly 150 configured to engage in rotation the auger rotating axle 138 of the auger assembly 124 and the impeller rotating axle 158—or impeller driving shaft 158—of the impeller assembly 126 simultaneously and in a manner such that the impeller revolution speed can differ from the auger revolution speed. The transmission assembly 150 is better shown in FIGS. 17 to 20.

Figure 19:
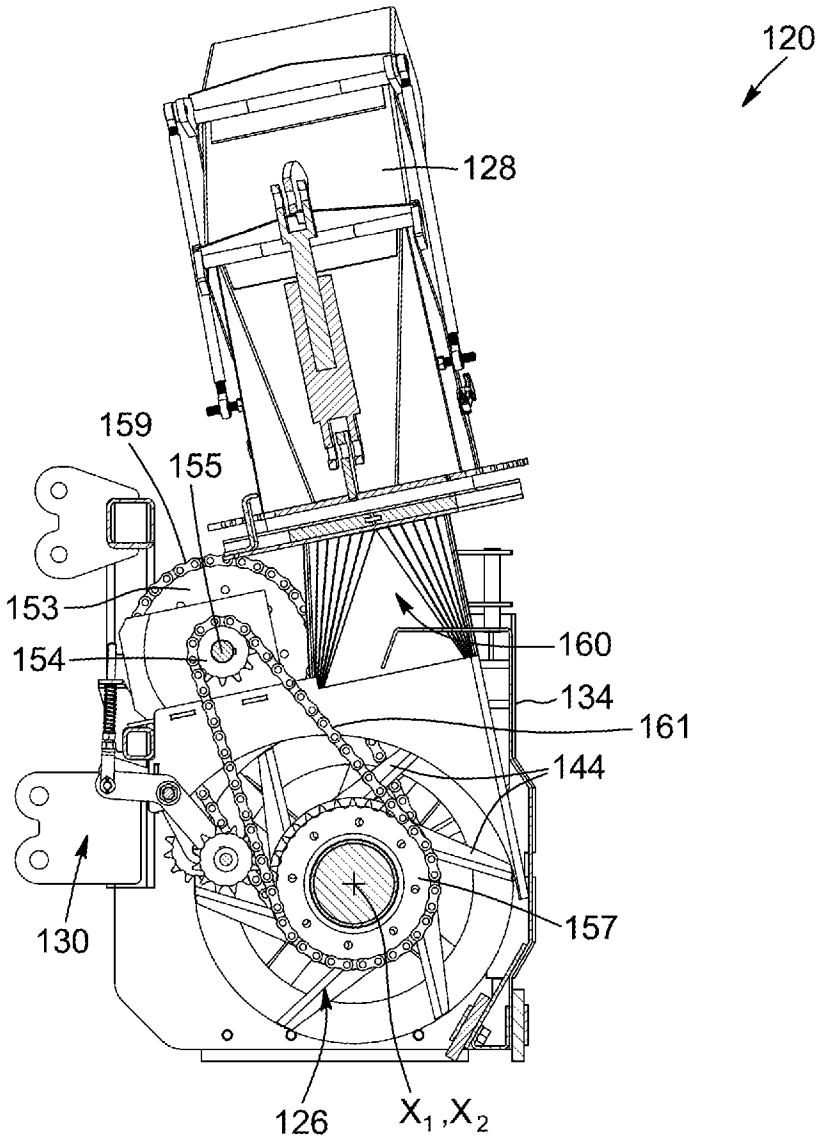
FIG. 19 is a cross-sectional view of the snowblower shown in FIG. 17 along section lines 19-19.
Figure 20:
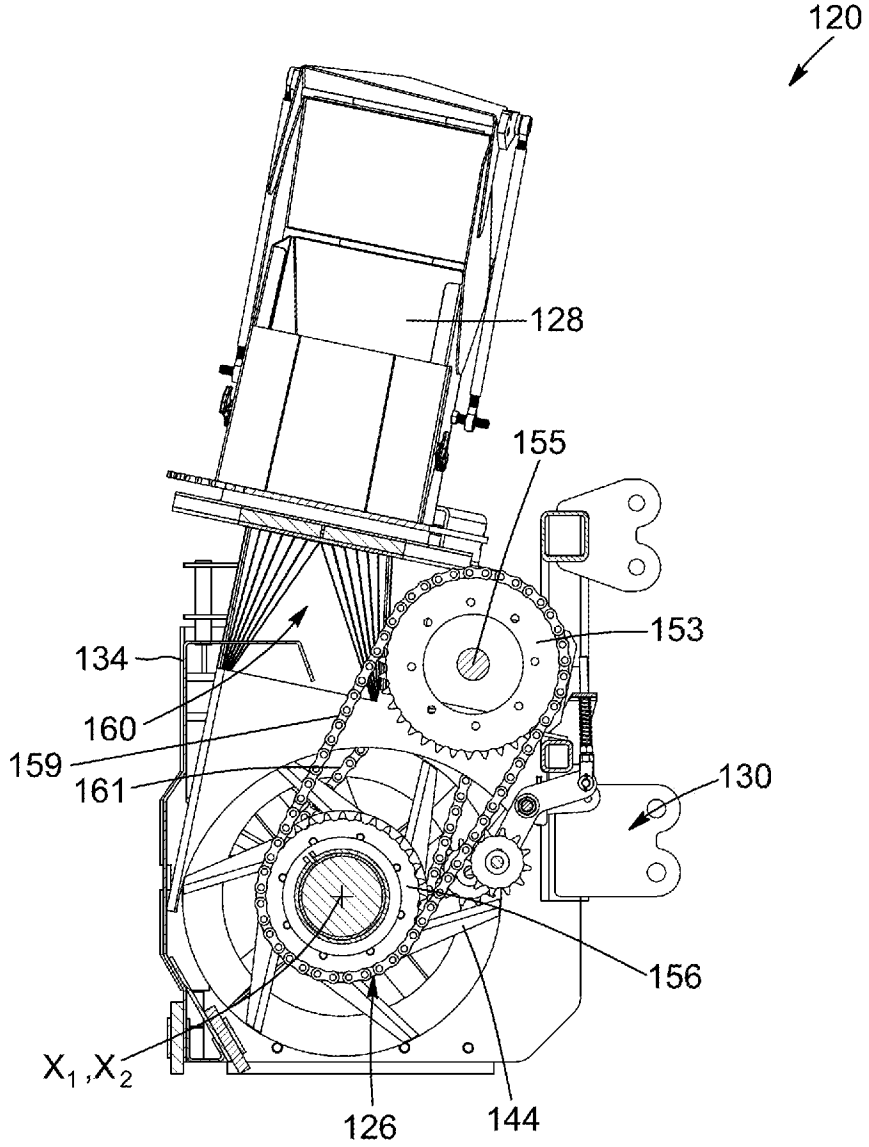
FIG. 20 is a cross-sectional view of the snowblower shown in FIG. 17 along section lines 20-20.

In the embodiment shown, the transmission assembly 150 includes a rotating power source 151 with a PTO shaft connector 152. The transmission assembly 150 further comprises a gear box comprising an impeller driving gear 153 and an auger driving gear 154, each one being mounted on a respective side of the rotating power source 151 and operatively engaged with a driving shaft 155 connected to the power source 151. As best shown in FIGS. 19 and 20, one of the driving gears 153, 154 (the impeller driving gear 153, in the embodiment shown) is of a larger diameter (and includes more teeth) than the other one of the driving gears 153, 154 (than the auger driving gear 154), as will be explained in more details below.

The impeller and auger driving gears 153, 154 are operatively engaged respectively with impeller and auger driven gears 156, 157 operatively engaged respectively with the impeller driving shaft 158 and the auger rotating axle 138. The impeller and auger driving gears 153, 154 are operatively engaged with the corresponding one of the impeller and auger driven gears 156, 157 through two respective transmission chains 159, 161. More particularly, the impeller transmission chain 159 connects the impeller driving gear 153, of a larger diameter and/or of a greater number of teeth, to the impeller driven gear 156 secured to the impeller driving shaft 158 to engage same in rotation. The auger transmission chain 161 connects the auger driving gear 154, of a smaller diameter and/or of a smaller number of teeth, to the auger driven gear 157 secured to the auger rotating axle 38 to engage same in rotation.

In the embodiment shown, the impeller and auger driven gears 156, 157 have substantially the same diameter and number of teeth. Since the impeller driving gear 153 includes more teeth and/or is of a larger diameter than the auger driving gear 154, the impeller driving shaft 158 and, therefore, the impeller assembly 126, rotates at a higher revolution speed than the auger rotating axle 138, even though the impeller driving shaft 158 is engaged in rotation by the same gearbox 51.

In alternative embodiments, the impeller and auger driven gears 156, 157 could be of different diameter and/or number of teeth. Thus, the transmission ratio can vary from the one shown in the figures.

Therefore, similarly to the previously described embodiments, the transmission assembly 150 is configured to engage the auger rotating axle 138 and the impeller assembly 126 in rotation and to provide a revolution speed increase between the auger revolution speed (i.e. the revolution speed of the two snow-gathering devices 140) and the impeller revolution speed.

It is appreciated that the transmission assembly 150 can vary from the embodiment shown. For instance, the impeller and auger transmission chains 159, 161 can be replaced by gears. The transmission assembly 150 can be either a variable transmission assembly, which can be controlled by the snowblower operator, or with a fixed ratio, such as a gear ratio. It is appreciated that the transmission can include a belt and pulley transmission instead of gear(s).

In the embodiment shown, the transmission assembly 150 (the rotating power source 151 thereof) is engaged in rotation via a shaft, such as a power take-off (PTO) shaft, powered by the vehicle, such as a tractor. In another embodiment, the transmission assembly 150 can be engaged via a hydraulic or electric actuator.

Thus, the rotation axis of the auger assembly 124 and the impeller assembly 126 is substantially perpendicular to a displacement axis of the vehicle to which the snowblower is mounted to and/or substantially parallel to the transversally extending portion 134 of the frame 122. It is also appreciated that the frame 122 could be pivotally mounted to a vehicle and, therefore, the rotation axis of the auger and the impeller assemblies 124, 126 could be variable with respect to the displacement axis of the vehicle.

As for the snowblower 20, the snowblower 120 can include two pivotable wings 170, similar to wings 70, and which will not be described in further details. Even though in the embodiment shown in FIGS. 15 to 2, the wing actuators extend above the transversally extending portion 134, they could be arranged substantially similarly to the embodiment represented in FIGS. 1 to 14. The vehicle attachment assembly 130 is also similar to the vehicle attachment assembly 30 and will not be further described.

In some implementations, the transmission assembly 50, 150, 250, the rotating axle(s) 38, 138, 238 and/or the impeller assembly 26, 126, 226 can be engaged in rotation via an auxiliary hydraulic or electric actuator, such as the ones available on skid steers.

In another embodiment (not shown), the snowblower 20, 120, 220 can be free of transmission assembly to provide a revolution speed difference between the auger assembly 24, 124, 224 and the impeller assembly 26, 126, 226. Each one of the auger assembly 24, 124, 224 and the impeller assembly 26, 126, 226 can be engaged into rotation by its own hydraulic actuator (i.e. independently from each other), such as and without being limitative an orbital hydraulic motor, which is included in the actuator assembly 49, 149, 249 of the snowblower 20, 120, 220.

General Principle

The impeller assembly 26, 126, 226 is in communication with the discharge chute 28, 128, 228, which is also mounted the snowblower frame 22, 122, 222, for instance to the transversally extending portion 34, 134, 234 thereof, for instance substantially centrally thereof. The discharge chute 28, 128, 228 extends above the frame 22, 122, 222 and, as mentioned above, can be pivotally mounted thereto to manage at least one of the direction and the height of the flow of snow/ice when blown by the snowblower 20, 120, 220, as it is known in the art. The discharge chute inlet 60, 160, 260, which is located adjacent to the impeller assembly 26, 126, 226. Therefore, the snow/ice propelled upwardly by the impeller assembly 26, 126, 226 is directed towards the discharge chute inlet 60, 160, 260 and into the discharge chute 28, 128, 228 to be propelled at a distance from the snowblower 20, 120, 220.

Method for Clearing Away Snow

According to another aspect of the disclosure, there is provided a method for clearing away snow. The method according to embodiments of the present disclosure may be carried out with a snowblower 20, 120, 220 as those described above.

The method comprises simultaneously engaging in rotation the auger rotating axle 38, 138, 238 of the auger assembly 124 and the plurality of paddles 44, 144, 244 of the impeller assembly 26, 126, 226 with the impeller revolution speed being greater than the auger revolution speed.

In the embodiment shown, wherein the transversally extending portion 34, 134, 234 of the snowblower frame 22, 122, 222 comprises two opposed ends, and wherein the snowblower further comprises two lateral wings pivotally mounted to or in the vicinity of the opposed ends of the transversally extending portion 34, 134, 234, the wings being pivotable about wing pivot axes extending substantially vertically, the method further comprises configuring the snowblower 20, 120, 220 in a snowblowing configuration wherein the pivoting lateral wings at least partially delimit with the transversally extending portion of the frame an auger-containing cavity.

In the embodiment wherein the transversally extending portion 34, 134, 234 comprises an auger-facing side and an opposed snowplowing side, the method might further comprise configuring the snowblower 20, 120, 220 in a snowplowing configuration wherein the pivoting lateral wings form with the snowplowing side of the transversally extending portion an angle smaller than about 180 degrees.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A snowblower comprising:

a snowblower frame with a transversally extending portion;

an auger assembly mounted to the snowblower frame and comprising at least one rotating axle extending substantially parallel to the transversally extending portion and at least one snow-gathering device mounted to the at least one rotating axle and rotating therewith about an auger rotating axis at an auger revolution speed;

an impeller assembly mounted to the snowblower frame and comprising an impeller driving shaft and at least one snow-expelling device supported by the impeller driving shaft and rotatable about an impeller rotation axis at an impeller revolution speed, wherein, considered in a plan transversal to said at least one rotating axle, the impeller driving shaft extends parallel to the at least one rotating axle and is spaced apart therefrom; and a discharge chute mounted to the snowblower frame and having a discharge chute inlet adjacent to the impeller assembly.

2. The snowblower according to claim 1, wherein the transversally extending portion has an auger-facing side, and wherein the impeller rotation axis extends at least one of above the auger rotation axis and further from the auger-facing side than the auger rotation axis, when the snowblower is supported on a ground surface.

3. The snowblower according to claim 1, further comprising at least one actuator assembly configured to engage the auger assembly and the impeller assembly in rotation wherein the impeller revolution speed is greater than the auger revolution speed.

4. The snowblower according to claim 3, wherein the at least one actuator assembly comprises a transmission assembly connecting the impeller assembly to the at least one rotating axle to increase the impeller revolution speed with respect to the auger revolution speed.

5. The snowblower according to claim 4, wherein the transmission assembly comprises a rotating power source, an impeller transmission subassembly and at least one auger transmission subassembly operatively connecting the rotating power source respectively to the impeller assembly and to the at least one rotating axle and wherein the auger assembly comprises first and second longitudinal ends and wherein said at least one auger transmission subassembly is mounted to one of the first and second longitudinal ends.

6. The snowblower according to claim 1, wherein the transversally extending portion of the snowblower frame comprises two opposed ends, the snowblower further comprising:

two wings pivotally mounted to said opposed ends of the transversally extending portion and pivotable about wing pivot axes extending substantially vertically; and two wing actuators, each one having a first end mounted to the snowblower frame and a second end mounted to a respective one of the two wings, said two wing actuators being configurable in a retracted configuration and an extended configuration wherein said two wings extend at least one of forwardly and rearwardly with respect to the transversally extending portion of the frame.

7. The snowblower according to claim 1, wherein the auger assembly comprises two rotating axles, concentric and spaced-apart from each other and two snow-gathering devices mounted to a corresponding one of the two rotating axles, the impeller driving shaft extending between the two rotating axles.

8. The snowblower according to claim 1, wherein a diameter of the impeller assembly is greater than or equal to a diameter of the auger assembly.

9. A method for clearing away snow with a snowblower according to claim 3, comprising simultaneously engaging in rotation the at least one rotating axle of the auger assembly and said at least one snow-expelling device of the impeller assembly with the impeller revolution speed being greater than the auger revolution speed.

10. The method according to claim 9, wherein the transversally extending portion comprises two opposed ends, the snowblower further comprising two wings pivotally mounted to said opposed ends of the transversally extending portion and pivotable about wing pivot axes extending substantially vertically, the method further comprising configuring the snowblower in at least one of a snowblowing configuration wherein said two wings at least partially delimit with the transversally extending portion of the frame an auger-containing cavity and a snowplowing configuration wherein said two wings form with the snowplowing side of the transversally extending portion an angle smaller than about 180 degrees.

11. A snowblower and snowplow assembly comprising:

a snowblower frame with a transversally extending portion comprising two opposed ends;

an auger assembly mounted to the snowblower frame and comprising at least one rotating axle extending substantially parallel to the transversally extending portion and at least one snow-gathering device mounted to the at least one rotating axle and rotating therewith about an auger rotating axis at an auger revolution speed;

an impeller assembly mounted to the snowblower frame and comprising at least one snow-expelling device rotatable about an impeller rotation axis at an impeller revolution speed, the impeller rotation axis extending substantially parallel to the auger rotating axis;

a discharge chute mounted to the snowblower frame and having a discharge chute inlet adjacent to the impeller assembly;

two wings pivotally mounted to the opposed ends of the transversally extending portion, and pivotable about wing pivot axes extending substantially vertically; and two wing actuators, each one having a first end mounted to the snowblower frame and a second end mounted to a respective one of the two wings, said two wing actuators being configurable in a retracted configuration and an extended configuration wherein said two wings extend at least one of forwardly and rearwardly with respect to the transversally extending portion of the frame.

12. The snowblower according to claim 11, wherein the transversally extending portion comprises two substantially vertical opposed edges, wherein the pivot axis of each of said two wings is located along a respective one of said two vertical edges.

13. The snowblower according to claim 11, wherein the impeller rotation axis is concentric with the auger rotating axis.

14. The snowblower according to claim 11, wherein the impeller assembly comprises an impeller driving shaft, at least one snow-expelling device comprising one or more paddles supported thereby and rotating therewith, and wherein the impeller driving shaft extends parallel to the at least one rotating axle and is spaced apart therefrom.

* * * * *